US011247813B2

(12) United States Patent
Mefford

(10) Patent No.: US 11,247,813 B2
(45) Date of Patent: Feb. 15, 2022

(54) CONTAINER ASSEMBLY AND SYSTEM AND METHOD THEREOF

(71) Applicant: Kao USA Inc., Cincinnati, OH (US)

(72) Inventor: David Mefford, Union Township, OH (US)

(73) Assignee: Kao USA Inc., Cincinnati, OH (US)

( * ) Notice: Subject to any disclaimer, the term of this patent is extended or adjusted under 35 U.S.C. 154(b) by 219 days.

(21) Appl. No.: 16/509,242

(22) Filed: Jul. 11, 2019

(65) Prior Publication Data

US 2020/0017257 A1 Jan. 16, 2020

Related U.S. Application Data

(60) Provisional application No. 62/696,691, filed on Jul. 11, 2018.

(51) Int. Cl.
*B65D 23/08* (2006.01)
*B65D 1/40* (2006.01)

(52) U.S. Cl.
CPC ..... *B65D 23/0857* (2013.01); *B65D 1/40* (2013.01)

(58) Field of Classification Search
CPC .. B65D 23/0857; B65D 1/40; B65D 23/0871; B65D 1/44; B65D 1/0223; A47J 41/0072
USPC ..... 215/12.1; 426/396
See application file for complete search history.

(56) References Cited

U.S. PATENT DOCUMENTS 3,250,416 A 5/1966 Clarke
3,738,524 A 6/1973 Richie
5,769,311 A 6/1998 Morita et al.
6,622,867 B2 9/2003 Menceles
7,000,775 B2 2/2006 Gelardi et al.
8,020,698 B2 9/2011 Gelardi
2009/0130275 A1 5/2009 Trost et al.
2014/0144868 A1 5/2014 Besson et al.

FOREIGN PATENT DOCUMENTS

FR 2 145 630 A1 2/1973

OTHER PUBLICATIONS

The International Search Report and Written Opinion of the International Searching Authority dated Oct. 4, 2019 in PCT/US19/41436 filed Jul. 11, 2019, citing documents AA-AE and AO, 10 pages.

*Primary Examiner* — Don M Anderson
*Assistant Examiner* — Madison L Poos
(74) *Attorney, Agent, or Firm* — Oblon, McClelland, Maier & Neustadt, L.L.P.

(57) ABSTRACT

A container assembly comprised of a sleeve can be provided so as to circumscribe an underlying container and fixedly coupled to the underlying container at one or more portions of the underlying container. The container can have sidewalls with a surface geometry or geometries that prevent or make difficult the application of either a pre-printed pressure sensitive label or direct printing. Thus, the sleeve can have a decoration of label provided therein, while as the same time optionally allowing viewing access to the underlying container. The sleeve can be supported by the underlying container and may have a rigidity less than a rigidity of the sidewall(s) with the surface geometry of the underlying container.

23 Claims, 13 Drawing Sheets

CONTAINER ASSEMBLY AND SYSTEM AND METHOD THEREOF

CROSS REFERENCE TO RELATED APPLICATION(S)

This application is based upon and claims benefit of priority from U.S. Provisional Patent Application 62/696,691, filed on Jul. 11, 2018, the entire contents of which are incorporated herein by reference.

FIELD

Embodiments of the disclosed subject matter are directed to a container assembly and a system and a method thereof. In particular, embodiments of the disclosed subject matter can involve a container assembly comprised of a container circumscribed by a sleeve.

SUMMARY

According to one or more embodiments of the disclosed subject matter, a containment system is provided. The containment system can comprise a container including: an upper wall portion, a lower wall portion, and a middle wall portion between the upper wall portion and the lower wall portion, where the middle wall portion has a surface geometry that includes a plurality of projections. The containment system can also comprise a sleeve including: an outer surface, an inner surface, a first end, and a second end opposite the first end. The inner surface of the sleeve can be fixedly coupled to at least one of the upper wall portion, the lower wall portion, and the middle wall portion, and the middle wall portion can have a rigidity greater than a rigidity of the sleeve.

Additionally, one or more embodiments of the disclosed subject matter can involve a method. The method can be comprised of providing a container having: an upper wall portion, a lower wall portion, and a middle wall portion between the upper wall portion and the lower wall portion, where the middle wall portion has a surface geometry that includes a plurality of projections. The method can also comprise providing a sleeve having: an outer surface, an inner surface, a first end, and a second end opposite the first end. The inner surface of the sleeve can be fixedly coupled to at least one of the upper wall portion, the lower wall portion, and the middle wall portion, and the middle wall portion can have a rigidity greater than a rigidity of the sleeve.

According to one or more embodiments of the disclosed subject matter a container assembly is provided. The container assembly can be comprised of a plastic container having: an upper wall portion, a lower wall portion, and a middle wall portion between the upper wall portion and the lower wall portion, where the middle well portion has a surface geometry that precludes receipt of a pre-printed pressure sensitive decoration and direct printing of a decoration, the surface geometry defining a plurality of projections. The container assembly can also comprise a plastic sleeve having an outer surface, an inner surface, a first open end, and a second end opposite the first open end. The plastic sleeve can surround the middle wall portion of the plastic container, wherein the inner surface of the plastic sleeve can be adjacent to at least one of the plurality of projections of the surface geometry of the middle wall portion and fixedly coupled to at least one of the upper wall portion at the first open end and the lower wall portion at the second end, and the middle wall portion can have a rigidity greater than a rigidity of the plastic sleeve.

Embodiments of the disclosed subject matter can also involve a containment system comprising: a blow molded plastic container configured to directly contain in an inner volume thereof a consumer product, the blow molded plastic container having: a shoulder portion, a base forming a bottom portion of the blow molded plastic container and configured to support the blow molded plastic container in an upright, standing position, on a standing surface, and at least one rigid, vertical sidewall between the shoulder portion and the base, with a surface geometry that precludes receipt of a pre-printed pressure sensitive decoration and direct printing of a decoration, the surface geometry defining a plurality of peaks and a plurality of valleys; and a semi-rigid plastic sleeve having a smooth outer surface, a smooth inner surface, a first open end, and a second open end opposite the first open end, the semi-rigid plastic sleeve surrounding said at least one rigid vertical wall such that the smooth inner surface of the semi-rigid plastic sleeve is fixed to the shoulder portion at the first open end and fixed to the base at the second open end, and in direct contact with the plurality of peaks, wherein the rigid vertical sidewall has a rigidity greater than that of the semi-rigid plastic sleeve, and wherein the semi-rigid plastic sleeve is transparent, semi-transparent, or opaque, except at a decoration area having a decoration thereon.

Embodiments can also include methods of providing, making, and/or using containers, containment assemblies, and containment systems, or portions thereof, according to one or more embodiments of the disclosed subject matter.

The preceding summary is to provide an understanding of some aspects of the disclosure. As will be appreciated, other embodiments of the disclosure are possible utilizing, alone or in combination, one or more of the features set forth above or described in detail below. Also, while the disclosure is presented in terms of exemplary embodiments, it should be appreciated that individual aspects of the disclosure can be separately claimed.

BRIEF DESCRIPTION OF THE DRAWINGS

The accompanying drawings, which are incorporated in and constitute a part of the specification, are illustrative of one or more embodiments of the disclosed subject matter, and, together with the description, explain various embodiments of the disclosed subject matter. Further, the accompanying drawings have not necessarily been drawn to scale, and any values or dimensions in the accompanying drawings are for illustration purposes only and may or may not represent actual or preferred values or dimensions. Where applicable, some or all select features may not be illustrated to assist in the description and understanding of underlying features.

DETAILED DESCRIPTION

Figure 1C:
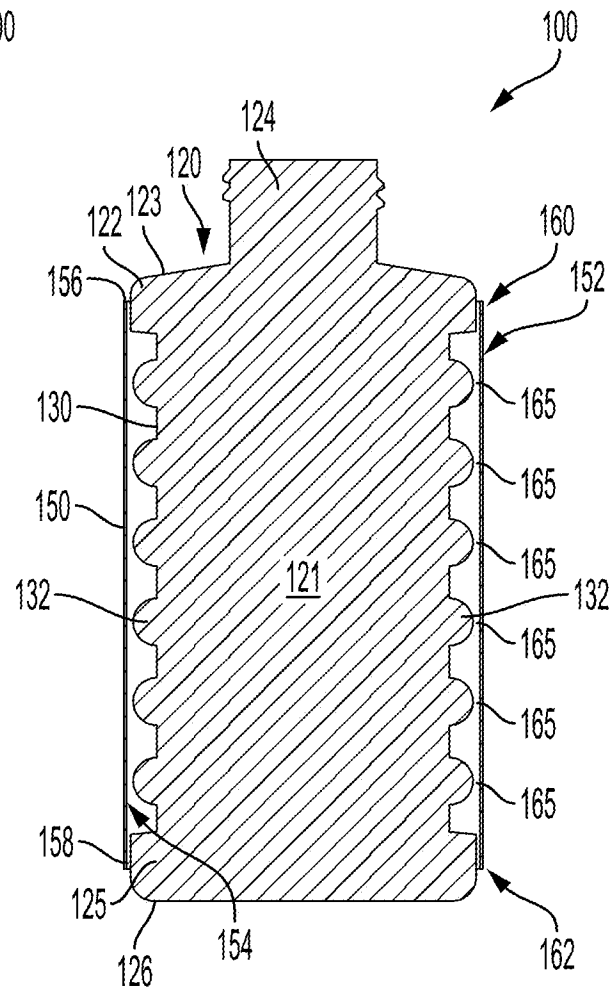
FIG. 1C is a cross-sectional view of the container assembly along line A-A of FIG. 1B.

The description set forth below in connection with the appended drawings is intended as a description of various embodiments of the described subject matter and is not necessarily intended to represent the only embodiment(s). In certain instances, the description includes specific details for the purpose of providing an understanding of the described subject matter. However, it will be apparent to those skilled in the art that embodiments may be practiced without these specific details. In some instances, structures and components may be shown in block diagram form in order to avoid obscuring the concepts of the described subject matter. Wherever possible, the same reference numbers will be used throughout the drawings to refer to the same or the like parts.

Any reference in the specification to "one embodiment" or "an embodiment" means that a particular feature, structure, characteristic, operation, or function described in connection with an embodiment is included in at least one embodiment. Thus, any appearance of the phrases "in one embodiment" or "in an embodiment" in the specification is not necessarily referring to the same embodiment. Further, the particular features, structures, characteristics, operations, or functions may be combined in any suitable manner in one or more embodiments, and it is intended that embodiments of the described subject matter can and do cover modifications and variations of the described embodiments.

It must also be noted that, as used in the specification, appended claims and abstract, the singular forms "a," "an," and "the" include plural referents unless the context clearly dictates otherwise. That is, unless clearly specified otherwise, as used herein the words "a" and "an" and the like carry the meaning of "one or more" or "at least one." The phrases "at least one," "one or more," "or," and "and/or" are open-ended expressions that can be both conjunctive and disjunctive in operation. For example, each of the expressions "at least one of A, B and C," "at least one of A, B, or C," "one or more of A, B, and C," "one or more of A, B, or C," "A, B, and/or C," and "A, B, or C" can mean A alone, B alone, C alone, A and B together, A and C together, B and C together, or A, B and C together. It is also to be noted that the terms "comprising," "including," and "having" can be used interchangeably.

It is to be understood that terms such as "left," "right," "top," "bottom," "front," "rear," "side," "height," "length," "width," "upper," "lower," "interior," "exterior," "inner," "outer," and the like that may be used herein, merely describe points of reference and do not necessarily limit embodiments of the described subject matter to any particular orientation or configuration. Furthermore, terms such as "first," "second," "third," etc. merely identify one of a number of portions, components, points of reference, operations and/or functions as described herein, and likewise do not necessarily limit embodiments of the described subject matter to any particular configuration or orientation.

Generally, embodiments of the disclosed subject matter involve a container assembly and a system and a method thereof. In particular, embodiments of the disclosed subject matter involve a container assembly comprised of a container circumscribed by a sleeve.

Generally, container assemblies according to embodiments of the disclosed subject matter can provide a means by which to decorate or add information to a container (e.g., bottle), particularly in a case where the container has a sidewall (or sidewalls) with surface geometry that may prevent or make difficult the application of either a pre-printed pressure sensitive label or direct printing. Non-limiting examples of such surface geometry for the sidewall(s) of the container include compound, undulated, waved, bubbled, rippled, pillowed, or ribbed surfaces. In particular, in embodiments of the disclosed subject matter, a sleeve can have thereon a decoration or added information associated with the underlying container and be provided over the sidewall(s) of the underlying container with the surface geometry. The sleeve can be supported by the underlying container and may have a rigidity less than a rigidity of the sidewall(s) with the surface geometry of the underlying container.

Embodiments of the disclosed subject matter can provide one or more of the following benefits: the sleeve can be applicable to a wide range of surface treatments and highly undulated compound surfaces; the sleeve can add another dimension to current 2-D decoration with 2-D to 3-D registration; the sleeve can provide the option for adding a new tactical feel to an underlying container; the sleeve can accept advanced printing methods, including hot stamping and tactical ink printing; the sleeve can allow graphics to extend 360 degrees around the underlying container; and can increase container volume perception and shelf impression.

Generally, according to embodiments of the disclosed subject matter, the sleeve can be fixedly coupled to the underlying container at one or more portions of the underlying container. Optionally, the sleeve may be adjacent to (which may include in contact with or not in contact with) portions of the surface geometry of the sidewall(s) of the underlying container. Thus, in one or more embodiments, at least the surface geometry of the sidewall(s) of the underlying container may provide superficial contact to the sleeve, particularly when a user handles the container assembly by way of the sleeve. For example, the rigidity of the sleeve may be such that the sleeve elastically deforms inward so as to contact portions of the surface geometry when the user applies a squeezing force (e.g., from their hand) to the sleeve to handle the container assembly. The sleeve may return to its original form when the squeezing force is removed.

Figure 1B:
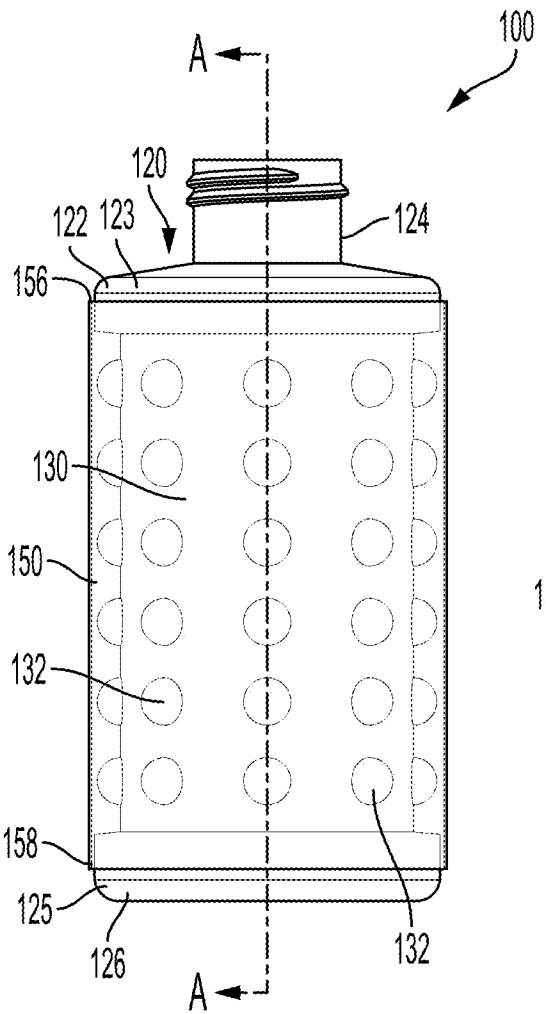
FIG. 1B is a side elevational view of the container assembly of FIG. 1A.
Figure 1A:
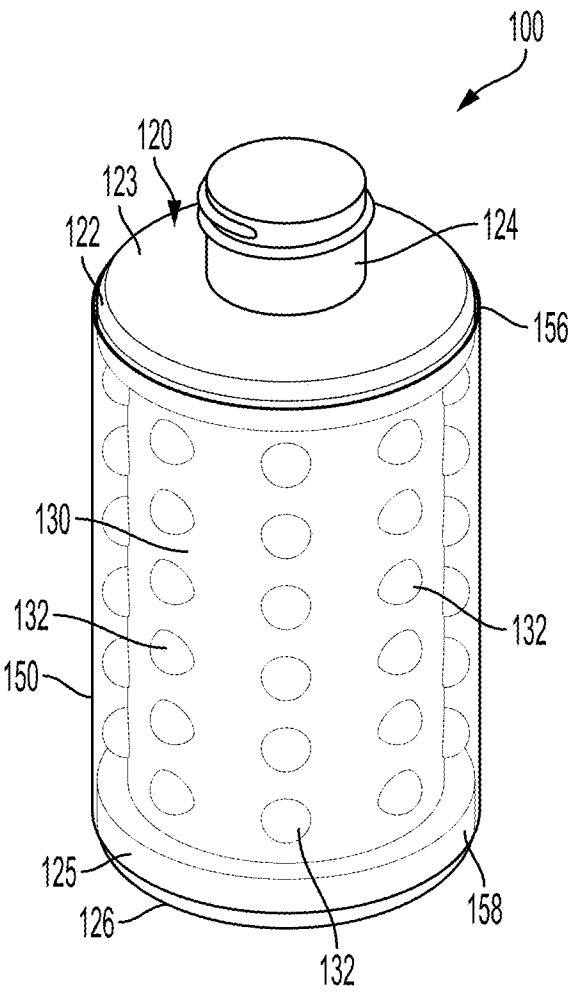
FIG. 1A is a perspective view of a container assembly according to one or more embodiments of the disclosed subject matter.

Turning to the figures, FIG. 1A is a perspective view of a container assembly 100 according to one or more embodiments of the disclosed subject matter. FIG. 1B is a side elevational view of the container assembly 100, and FIG. 1C is a cross-sectional view of the container assembly 100 along line A-A of FIG. 1B. As shown in FIGS. 1A-1C, the container assembly 100 can be comprised of a container 120 and a sleeve 150.

The container 120 may be made of plastic, such as high density polyethylene (HDPE), polypropylene (PP), and polyethylene terephthalate (PET). Further, the container 120 may be formed by blow molding, for instance, extrusion or injection blow molding. The sleeve 150 may be made of plastic, such as a semi-rigid plastic. Thus, the sleeve 150, due to the type and configuration of the plastic, may be less rigid than some or all of the container 120. Further, discussed in more detail below, the sleeve 150 may be formed from a flat sheet of the semi-rigid plastic.

The container 120 can include an upper wall portion 122, a lower wall portion 125, and a middle wall portion 130 between the upper wall portion 122 and the lower wall portion 125. The upper wall portion 122, the lower wall portion 125, and the middle wall portion 130 may form one or more sidewalls of the container 120. FIGS. 1A-1C show the container 120 having one sidewall. Further, as shown in FIGS. 1A-1C, the container 120 can be cylindrical (or generally cylindrical due to the surface geometry of the middle wall portion 130). Of course, embodiments of the disclosed subject matter are not so limited. Thus, containers according to embodiments of the disclosed subject matter can have a plurality of sidewalls and may take forms other than cylinders, such as oval, square, or rectangular in top and/or bottom plan views.

The upper wall portion 122 may have a shoulder 123 and a neck 124 that defines an opening to receive and dispense product contained in an inner volume 121 of the container 120. The neck 124 may have an interface, such as threads, to removably couple thereto a cap or dispensing apparatus (not shown). The lower wall portion 125 may form base 126, which may be configured to support the container 120 in an upright, standing position on a standing surface (not shown).

The middle wall portion 130 may extend vertically or substantially vertically between the upper wall portion 122 and the lower wall portion 125. The middle wall portion 130 can have a surface geometry that includes a plurality of projections or raised portions 132 and non-raised portions 134. Thus, embodiments of the disclosed subject matter can have a middle wall portion with a surface geometry that defines peaks and valleys. Such surface geometry may prohibit or preclude receipt of a pre-printed pressure sensitive decoration and/or direct printing of a decoration. As used herein, decoration may mean or include a label. Further, the middle wall portion according to embodiments of the disclosed subject matter, such as middle wall portion 130, may not have a relatively flat decoration panel configured to receive a pre-printed pressure sensitive decoration and/or direct printing of a decoration.

The sleeve 150 can include an outer surface 152, an inner surface 154, a first end 156, and a second end 158 opposite the first end 156. The sleeve 150 may define one or more sidewalls. For instance, FIGS. 1A-1C show sleeve 150 having one continuous sidewall, though embodiments of the disclosed subject matter are not so limited. Further, FIGS. 1A-1C show the sleeve 150 having the same number of sidewalls as the container 120. However, the sleeve 150 and the container 120, or some or all wall portions thereof, may differ in the number of sidewalls. For example, the container 120 may have more sidewalls than the sleeve 150.

The sleeve 150 may have a thicknesses less than a thickness of some or all of the container 120, such as the middle wall portion 130, each of the upper wall portion 122 and the lower wall portion 125, or each of the upper wall portion 122, the lower wall portion 125, and the middle wall portion 130. Thus, the sleeve 150, due its thickness in addition to or in the alternative of its plastic composition, may be less rigid than some or all of the container 120.

In embodiments of the disclosed subject matter, one or both of the first end 156 and the second end 158 may be open. FIGS. 1A-1C show both the first end 156 and the second end 158 of the sleeve 150 being open. In a case where one of the first end 156 and the second end 158 is not open, such end may be closed. For example, in one or more embodiments of the disclosed subject matter, the second end 158 of the sleeve may be closed.

The bottom end 158 of the sleeve 150 may be flush with the base 126 of the container 120, or, alternatively, the bottom end 158 of the sleeve 150 may be at a height above the base 126, such as shown in FIGS. 1A-1C. In the case of the bottom end 158 of the sleeve 150 being flush with the base 126, the sleeve 150 may support the container assembly 100 with the base 126. In such a configuration, the bottom end 158 of the sleeve 150 may be open or closed.

The inner surface 154 and/or the outer surface 152 of the sleeve 150 can be smooth. For instance, the inner surface 154 and/or the outer surface 152 of the sleeve 150 can be configured to receive a pre-printed pressure sensitive decoration and/or direct printing of a decoration. In one or more embodiments, such decoration may be applied to the sleeve 150 prior to the sleeve being provided around the container 120.

The sleeve 150 may be transparent, semi-transparent, or opaque, or a combination thereof. For example, the sleeve 150 may be transparent or semi-transparent, except at an area having a decoration. Such area may be semi-transparent or opaque, or a combination of the two.

The sleeve 150 can be provided so as to circumscribe the container 120. For example, FIGS. 1A-1C show the sleeve circumscribing all of the middle wall portion 130 and some of each of the upper wall portion 122 and the lower wall portion 125. Of course, embodiments of the disclosed subject matter can circumscribe all of the upper wall portion 122 and all of the lower wall portion 125.

The inner surface 154 of the sleeve 150 may be fixedly coupled to one, some, or all of the upper wall portion 122, the lower wall portion 125, and the middle wall portion 130. FIGS. 1A-1C, for instance, show the inner surface 154 of the sleeve 150 being fixedly coupled to the upper wall portion 122 and the lower wall portion 125 at a first coupling area 160 and a second coupling area 162. Alternatively, the inner surface 154 of the sleeve 150 may be fixedly coupled to only one of the upper wall portion 122 and the lower wall portion 125 at the first coupling area 160 and the second coupling area 162, respectively. Notably, FIGS. 1A-1C also show that the inner surface 154 of the sleeve 150 is not fixedly coupled to the middle wall portion 130.

However, the inner surface 154 of the sleeve 150 may be adjacent to the middle wall portion 130, particularly some or all of the projections 132. In this context, adjacent to can mean that the inner surface 154 of the sleeve 150 contacts some or all of the projections 132 in a normal state. Alternatively, adjacent to can mean that the inner surface 154 of the sleeve 150 does not contact any of the projections 132 in the normal state, but an inward force may be applied to the outer surface 152 of the sleeve 150 to cause the inner surface 154 to come into contact with one or more of the projections 132 in a handled state. The handled state may occur when a user grabs the container assembly 100 by squeezing the sleeve 150, particularly the outer surface 152 of the sleeve 150. Thus, one, some, or all of the projections 132 that contact the inner surface 154 of the sleeve 150 may provide superficial contact with the container 120 in the normal state and/or the handled state. FIGS. 1B and 1C, for instance, may show that the inner surface 154 of the sleeve 150 does not contact the projections 132 in the normal state; however, an external inward force applied to the sleeve 150 can cause the inner surface 154 of the sleeve 150 to come into contact with one, some, or all of the projections 132 and contact areas 165. Thus, in one or more embodiments of the disclosed subject matter, the rigidity of the sleeve 150 may be such that a predetermined amount of inward force applied to the sleeve 150 causes the inner surface 154 of the sleeve 150 to contact at least one of the plurality of projections 132 of the surface geometry of the middle wall portion 130. Further, the inner surface 154 of the sleeve 150 may return to a pre-inward force position when the predetermined amount of inward force is removed.

The inner surface 154 of the sleeve 150 may be fixedly coupled to the container 120 via diametral interference, i.e., press or friction fit, or via an adhesive, heat bonding, snap or bead fit, or notch-fit via a notch and notch receptacle configuration. Optionally, the sleeve 150 and container 120 may be configured such that the sleeve 150 can be introduced for fixedly coupling to the container 120 in only one direction, such as sliding the sleeve 150 over the container 120 from the top or from the bottom of the container 120. Alternatively, the sleeve 150 may be slid onto the container 120 from either direction.

Figure 2:
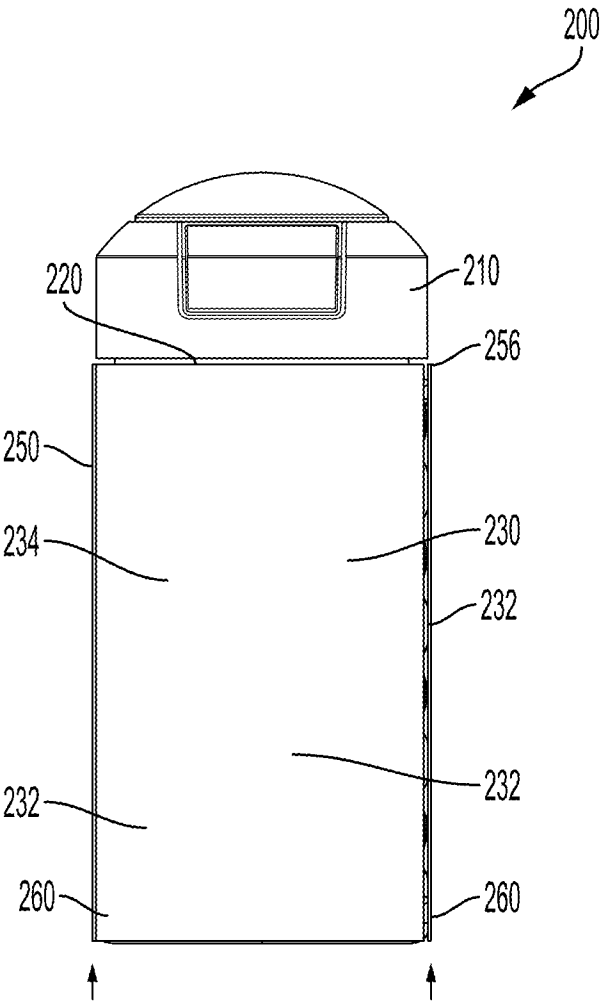
FIG. 2 is a side elevational view of a containment system according to one or more embodiments of the disclosed subject matter.

FIG. 2 is a side elevational view of a containment system 200 according to one or more embodiments of the disclosed subject matter. Generally, the containment system 200 can be comprised of a dispensing assembly 210, a container 220, and a sleeve 250.

The container 220 and the sleeve 250 can be similar to as discussed above for FIGS. 1A-1C, but may differ in a few aspects. For example, the container 220 can be a volumetric oval, and the sleeve 250 can circumscribe the container 220 as shown in FIG. 2. Further, the container 220 can have a middle wall portion 230 with a surface geometry that includes a plurality of projections or raised portions 232 and non-raised portions 234. Such surface geometry may be referred to as bubbled, and may prohibit or preclude receipt of a pre-printed pressure sensitive decoration and/or direct printing of a decoration. Further, the middle wall portion 230 may not have a relatively flat decoration panel configured to receive a pre-printed pressure sensitive decoration and/or direct printing of a decoration.

Though FIG. 2 shows the sleeve 250 being transparent, the sleeve 250 may additionally or alternatively be semi-transparent, opaque, or a combination thereof. For example, the sleeve 250 may be transparent or semi-transparent, except at an area having a decoration (not shown in FIG. 2).

In the case of the containment system 200 of FIG. 2, the sleeve 250 may be slidable onto the container 220 as shown only from the bottom (see arrows). For example, the sleeve 250 may be slid over the bottom of the container 220 and moved toward the top of the container 220 such that a first end 256 of the sleeve 250 is adjacent to the dispensing assembly 210. The sleeve 250 may engage a lower wall portion 225 of the container 220 via a snap fit 260 between the sleeve 250 and the lower wall portion 225. Such snap fit may be the only coupling to fixedly couple the sleeve 250 to the container 220. Thus, the sleeve 250 may not be fixedly coupled to the middle wall portion 230, particularly the raised portions 232.

Of course, the sleeve 250 may be adjacent to the middle wall portion 230, particularly some or all of the raised portions 232. In this context, adjacent to can mean that the sleeve 250 contacts some or all of the raised portions 232 in a normal state. Alternatively, adjacent to can mean that the sleeve 250 does not contact any of the raised portions 232 in the normal state, but an inward force may be applied to the sleeve 250 to cause the sleeve 250 to come into contact with one or more of the raised portions 232 in a handled state. The handled state may occur when a user grabs the containment system 200 by squeezing the sleeve 250. Thus, one, some, or all of the raised portions 232 that contact the sleeve 250 may provide superficial contact with the container 220 in the normal state and/or the handled state. The sleeve 250 may return to a pre-inward force position when the predetermined amount of inward force is removed.

Figure 3:
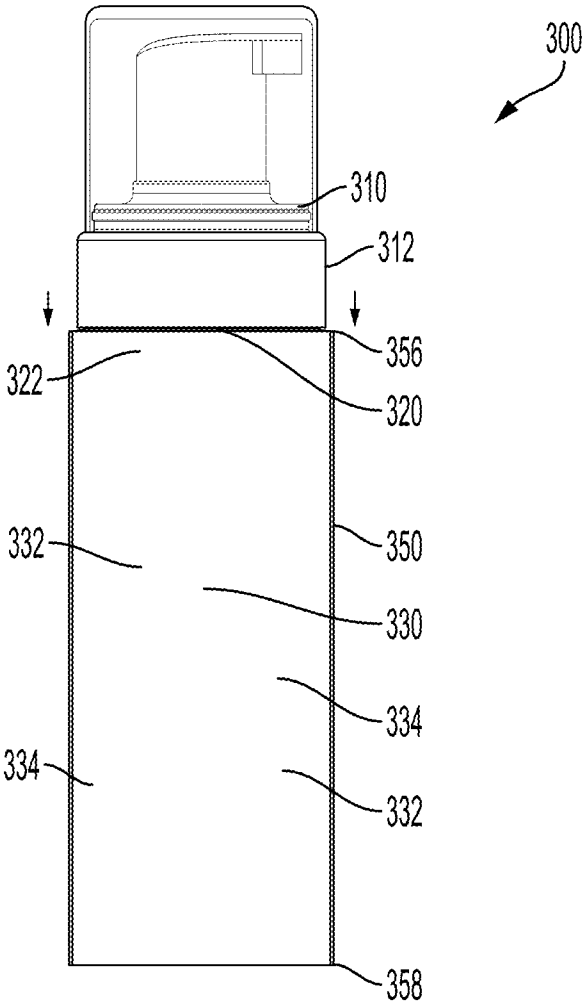
FIG. 3 is a side elevational view another containment system according to one or more embodiments of the disclosed subject matter.

FIG. 3 is a side elevational view another containment system 300 according to one or more embodiments of the disclosed subject matter. Generally, the containment system 300 can be comprised of a dispensing assembly 310, a container 320, and a sleeve 350. The dispensing assembly 310 may include a cap 312, which may be releasably coupled to the container 320, for instance, via a threaded interface.

The container 320 and the sleeve 350 can be similar to as discussed above for FIGS. 1A-1C, but may differ in a few aspects.

For example, the container 320 can have a middle wall portion 330 with a surface geometry that includes a plurality of projections or raised portions 332 and non-raised portions 334. Such surface geometry may prohibit or preclude receipt of a pre-printed pressure sensitive decoration and/or direct printing of a decoration. Further, the middle wall portion 330 may not have a relatively flat decoration panel configured to receive a pre-printed pressure sensitive decoration and/or direct printing of a decoration.

Though FIG. 3 shows the sleeve 350 being transparent, the sleeve 350 may additionally or alternatively be semi-transparent, opaque, or a combination thereof. For example, the sleeve 350 may be transparent or semi-transparent, except at an area having a decoration (not shown in FIG. 3).

In the case of the containment system 300 of FIG. 3, the sleeve 350 may be slidable onto the container 320 as shown only from the top (see arrows). For example, the dispensing assembly 310 may be removed from the container 320 and the sleeve 350 may be slid over the top of the container 320 and moved toward the bottom of the container 320. The dispensing assembly 310 may then be removably coupled to a neck of the container 320 such that a first end 356 of the sleeve 350 is adjacent to the bottom of the dispensing assembly 310, particularly, the bottom of the cap 312. The second end 358 of the sleeve 350 may not proceed past a bottom of the container 320. Thus, the sleeve 350 may be captured around the container 320 by way of the cap 312. The sleeve 350 may not be fixedly coupled to the middle wall portion 330, particularly the raised portions 332.

The sleeve 350 may be adjacent to the middle wall portion 330, particularly some or all of the raised portions 332. In this context, adjacent to can mean that the sleeve 350 contacts some or all of the raised portions 332 in a normal state. Alternatively, adjacent to can mean that the sleeve 350 does not contact any of the raised portions 332 in the normal state, but an inward force may be applied to the sleeve 350 to cause the sleeve 350 to come into contact with one or more of the raised portions 332 in a handled state. The handled state may occur when a user grabs the containment system 300 by squeezing the sleeve 350. Thus, one, some, or all of the raised portions 332 that contact the sleeve 350 may provide superficial contact with the container 320 in the normal state and/or the handled state. The sleeve 350 may return to a pre-inward force position when the predetermined amount of inward force is removed.

Figure 4:
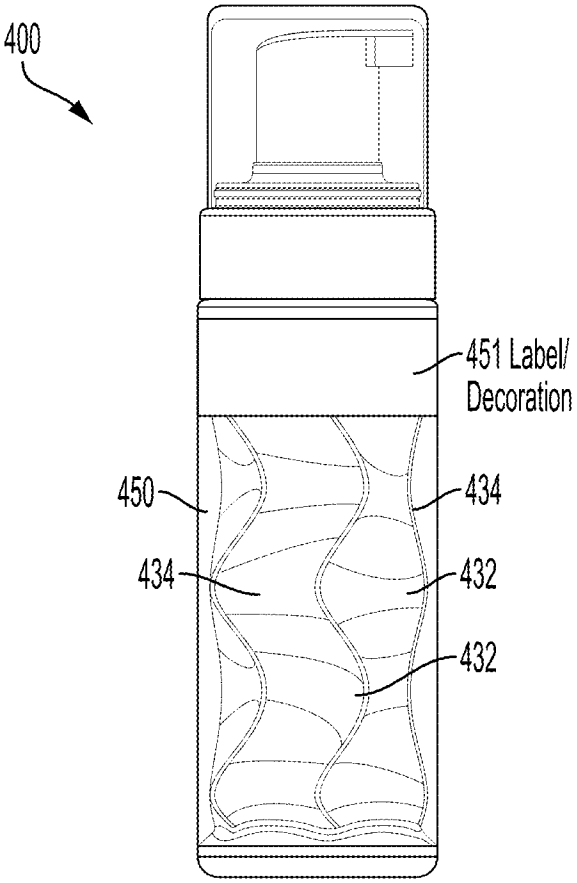
FIG. 4 is a side elevational view a containment system according to one or more embodiments of the disclosed subject matter.
Figure 6B:
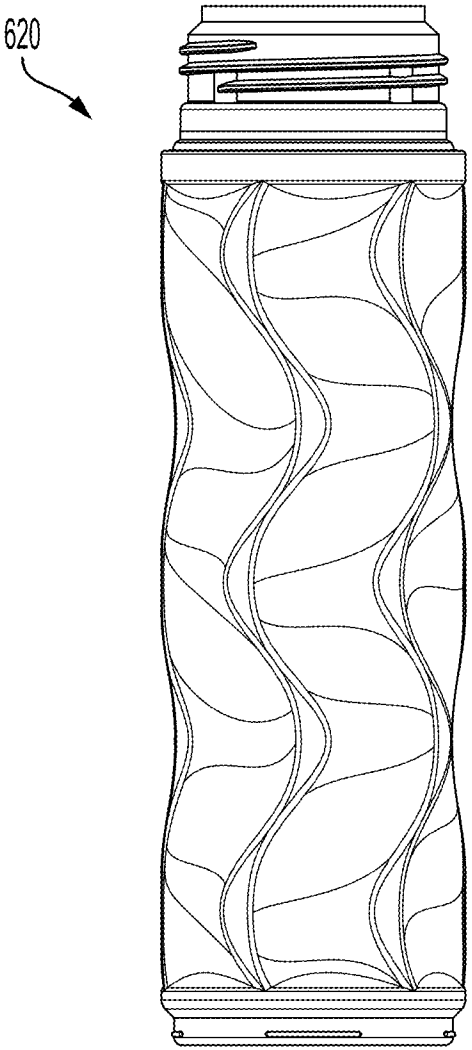
FIG. 6B is a side view elevational view of the container of FIG. 6A.
Figure 6A:
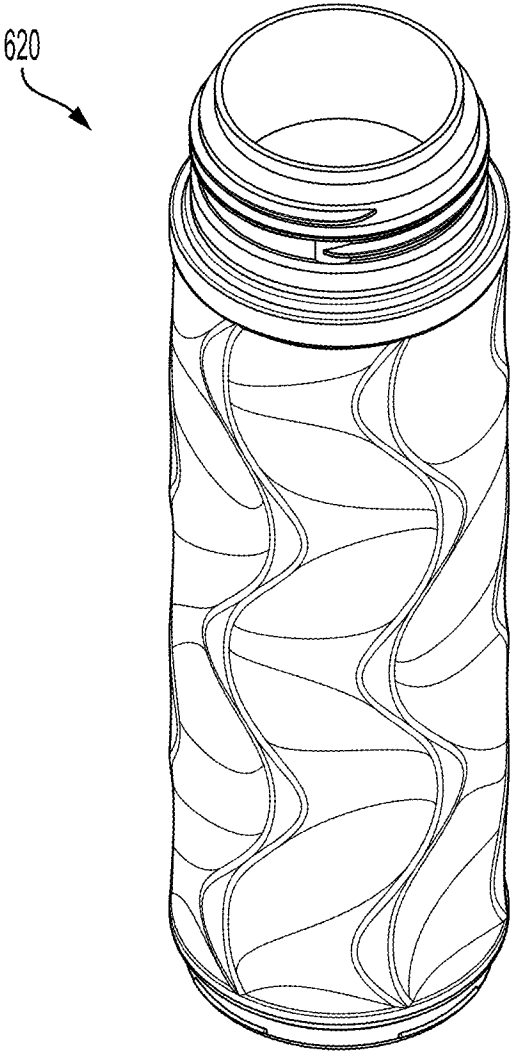
FIG. 6A is a perspective view of a container according to one or more embodiments of the disclosed subject matter.

FIG. 4 is a side elevational view a containment system 400 according to one or more embodiments of the disclosed subject matter. The containment system 400 is similar to the containment system 300 of FIG. 3, but notably includes a different surface geometry for the middle wall portion 430 of the container 420. In this case, the surface geometry may be referred to as waved or undulated and can include a plurality of projections or raised portions 432 and non-raised portions 434. Such surface geometry may prohibit or preclude receipt of a pre-printed pressure sensitive decoration and/or direct printing of a decoration. Further, the middle wall portion 430 may not have a relatively flat decoration panel configured to receive a pre-printed pressure sensitive decoration and/or direct printing of a decoration. The containment system 400 also expressly shows a label or decoration area 451 on the sleeve 450. In this case, the decoration area 451 is opaque, though it may be transparent or semi-transparent, and covers a relatively small portion of the sleeve 450. Thus, the surface geometry of the middle wall portion 430 of the underlying container 420 may be largely viewable through the sleeve 450.

Figure 5:
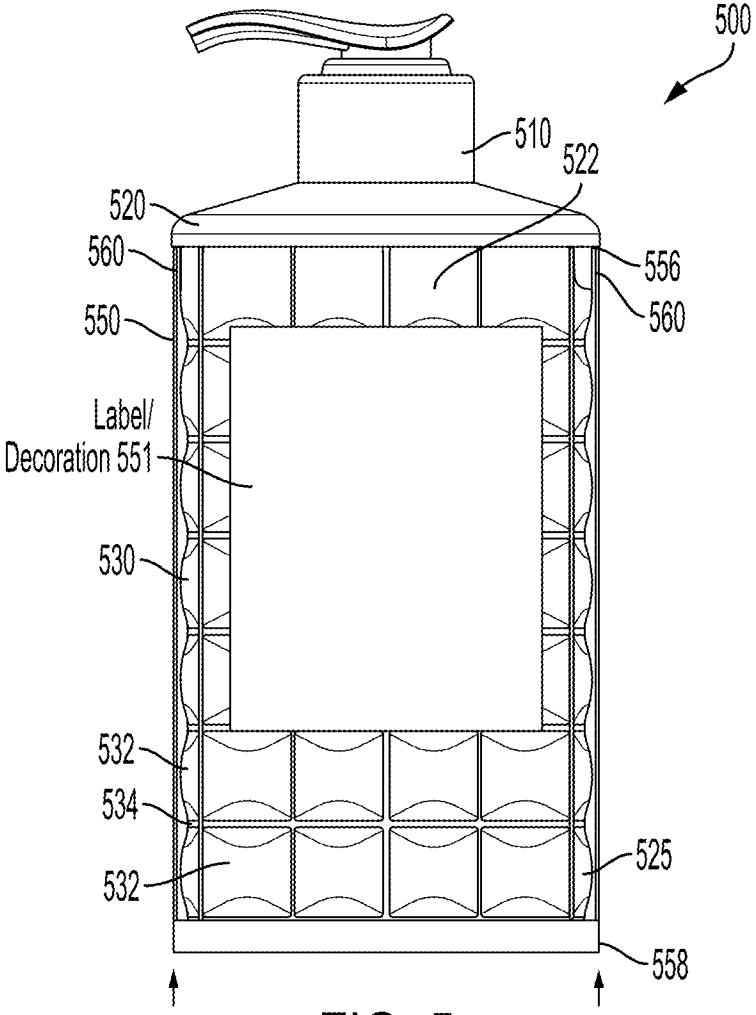
FIG. 5 is a side elevational view another containment system according to one or more embodiments of the disclosed subject matter.

FIG. 5 is a side elevational view another containment system 500 according to one or more embodiments of the disclosed subject matter. The containment system 500 can be comprised of a dispensing assembly 510, a container 520, and a sleeve 550.

The container 520 and the sleeve 550 can be similar to as discussed above for FIGS. 1A-1C and 2, but may differ in a few aspects. For example, the container 520 can have a middle wall portion 530 with a surface geometry that includes a plurality of projections or raised portions 532 and non-raised portions 534 as shown in FIG. 5. Such surface geometry may be referred to as pillowed, and may prohibit or preclude receipt of a pre-printed pressure sensitive decoration and/or direct printing of a decoration. Further, the middle wall portion 530 may not have a relatively flat decoration panel configured to receive a pre-printed pressure sensitive decoration and/or direct printing of a decoration.

The sleeve 550 of FIG. 5 includes a label or decoration area 551. In this case, the decoration area 551 is opaque, though it may be transparent or semi-transparent. Further, the decoration area 551 may cover a relatively small portion of the sleeve 550. Thus, the surface geometry of the middle wall portion 530 of the underlying container 520 may be largely viewable through the sleeve 550. Of course, though FIG. 5 shows the sleeve 550 being transparent except for the decoration area 551, the sleeve 550 may additionally or alternatively be semi-transparent, opaque, or a combination thereof.

In the case of the containment system 500 of FIG. 5, the sleeve 550 may be slidable onto the container 520 as shown, only from the bottom of the container 520 (see arrows), for instance. For example, the sleeve 550 may be slid over the bottom of the container 520 and moved toward the top of the container 520 such that a first end 556 of the sleeve 550 is adjacent to the dispensing assembly 510. The sleeve 550 may engage an upper wall portion 522 of the container 520 via locking tabs 560 on opposite sides of the container 520. Such locking tabs 560 may be the only coupling to fixedly couple the sleeve 550 to the container 520. Thus, the sleeve 550 may not be fixedly coupled to the middle wall portion 530, particularly the raised portions 532, or the lower wall portion 525. Optionally, the second end 558 of the sleeve 550 may form a base of the containment system 500. Thus, either the second end 558 of the sleeve 550 can form the base without the bottom of the container 520, or the second end 558 of the sleeve 550 and the bottom of the container 520 can form the base of the containment system 500.

The sleeve 550 may be adjacent to the middle wall portion 530, particularly some or all of the raised portions 532. Adjacent to can mean that the sleeve 550 contacts some or all of the raised portions 532 in a normal state. Alternatively, adjacent to can mean that the sleeve 550 does not contact any of the raised portions 532 in the normal state, but an inward force may be applied to the sleeve 550 to cause the sleeve 550 to come into contact with one or more of the raised portions 532 in a handled state. The handled state may occur when a user grabs the containment system 500 by squeezing the sleeve 550. Thus, one, some, or all of the raised portions 532 that contact the sleeve 550 may provide superficial contact with the container 520 in the normal state and/or the handled state. The sleeve 550 may return to a pre-inward force position when the predetermined amount of inward force is removed.

FIGS. 6A and 6B, 7A and 7B, 8A and 8B are perspective and side views, respectively, of underlying containers according to embodiments of the disclosed subject matter. For instance, the container 620 shown in FIGS. 6A and 6B may correspond to the container 420 in FIG. 4. As another example, the container 820 shown in FIGS. 8A and 8B may correspond to the container 320 in FIG. 3.

Figure 7B:
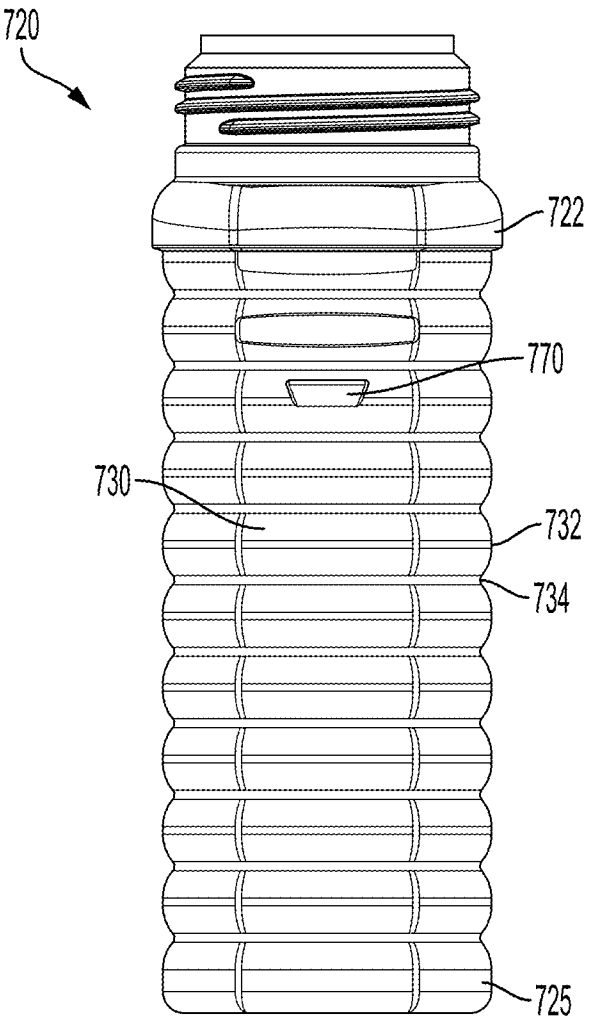
FIG. 7B is a side view elevational view of the container of FIG. 7A.
Figure 7A:
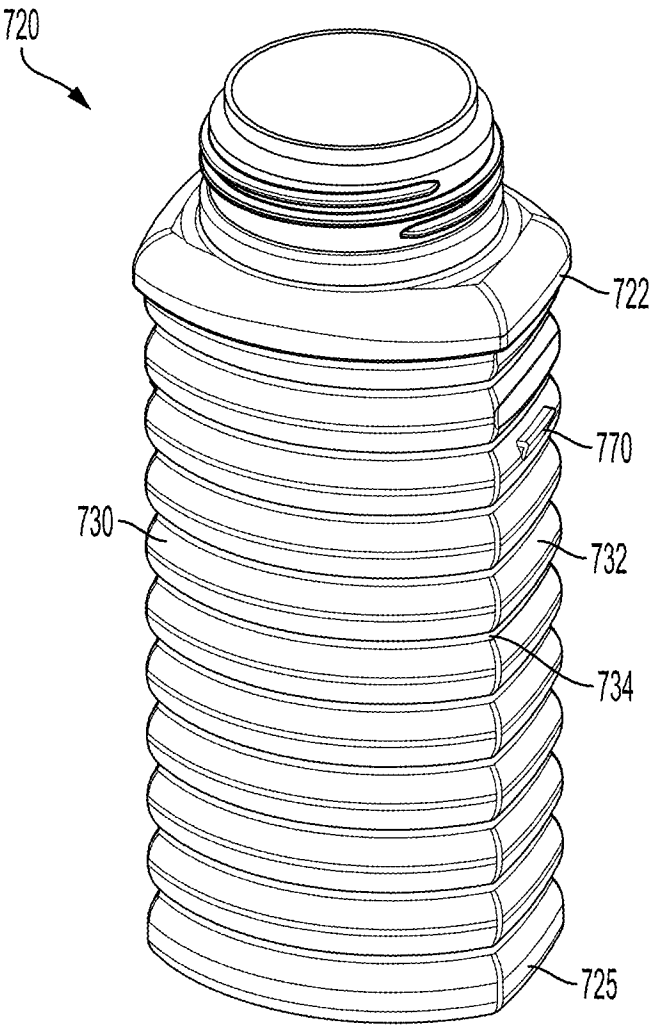
FIG. 7A is a perspective view of another container according to one or more embodiments of the disclosed subject matter.
Figure 8B:
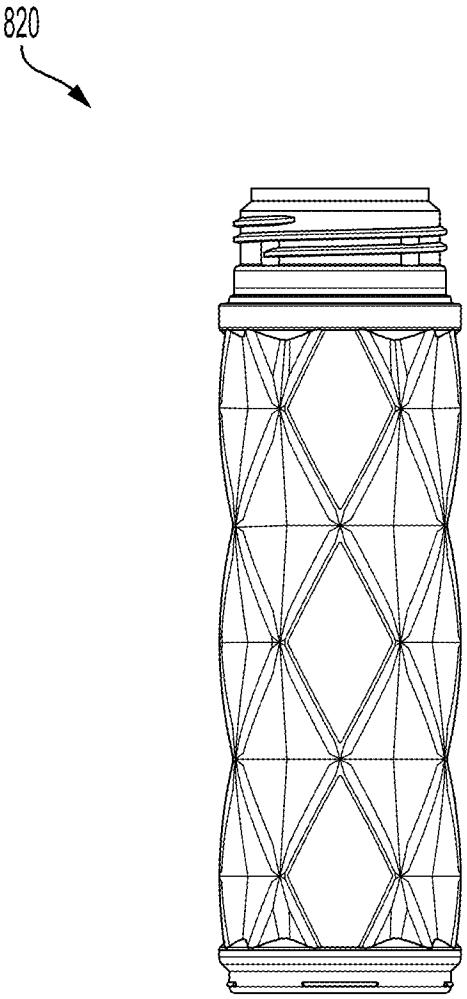
FIG. 8B is a side view elevational view of the container of FIG. 8A.
Figure 8A:
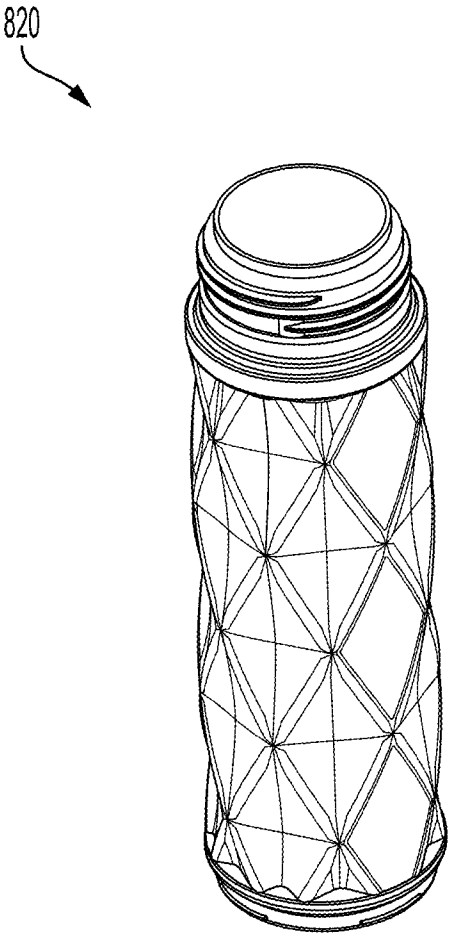
FIG. 8A is a perspective view of yet another container according to one or more embodiments of the disclosed subject matter.

Generally, the container 720 in FIGS. 7A and 7B may have a middle portion 730 that includes a plurality of alternating projections or raised portions 732 and non-raised portions 734. Container 720 also may be interpreted as having four vertical sidewalls. Additionally, container 720 can have a plurality of tabs 770, a pair, for instance, on opposing sidewalls of the middle portion 730. Such tabs 770 may be similar to or the same as those identified above for FIG. 5, and may be configured to fixedly couple a sleeve thereto when the sleeve is fitted over the container 720. For example, the tabs 770 may frictionally engage the sleeve to fixedly couple the sleeve to the container 720. Optionally, the tabs 770 may be the only areas in which the inner surface of the sleeve contacts the container 720. That is, the inner surface of the sleeve may not contact an upper wall portion 722 and a lower wall portion 725 of the container 720. However, a first end of the sleeve may be adjacent to (including abut) the upper wall portion 722.

Figure 9:
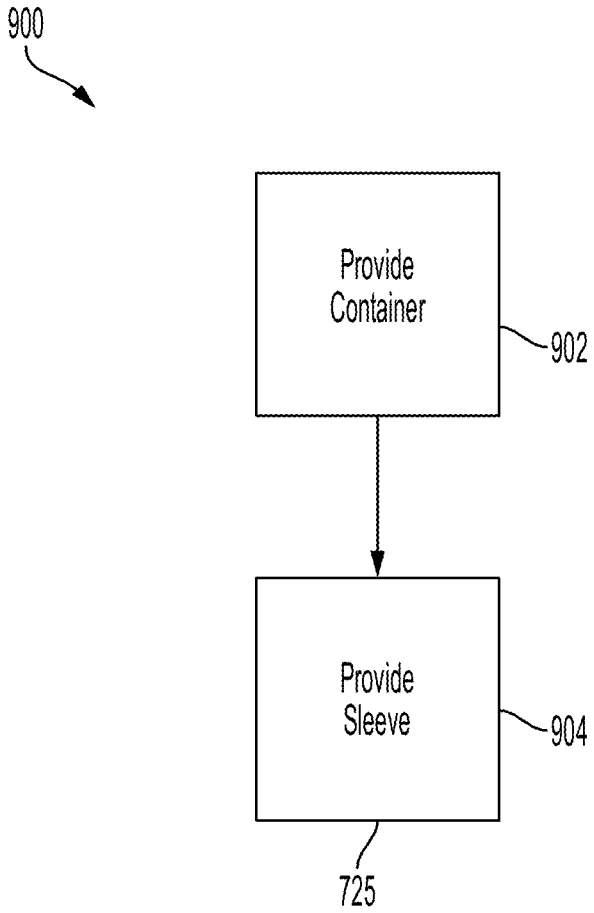
FIG. 9 is a flow chart of a method according to one or more embodiments of the disclosed subject matter.

FIG. 9 is a flow chart of a method 900 according to one or more embodiments of the disclosed subject matter. The method 900 can represent methods of making, using, and/or providing sleeves, containers, container assemblies, and container systems according to embodiments of the disclosed subject matter.

The method 900 can include a block 902 whereby a container according to embodiments of the disclosed subject matter is provided. Block 902 can represent the operation of making such container and/or providing or using such container, including in combination with a sleeve according to embodiments of the disclosed subject matter. The method 900 can also include a block 904 whereby a sleeve according to embodiments of the disclosed subject matter is provided. Block 904 can represent the operation of making such sleeve and/or providing or using such sleeve, including in combination with the container provided at block 902. Also FIG. 9 shows block 902 before block 904, the order may be reversed, or the operations associated with the blocks can occur at the same time, such as when a container assembly or containment system is provided upon manufacture or for sale.

FIGS. 10A-10F show a flow diagram of a method 1000 of making a container assembly according to one or more embodiments of the disclosed subject matter.

Figures 10A, 10B, 10C, 10D, 10E, 10F:
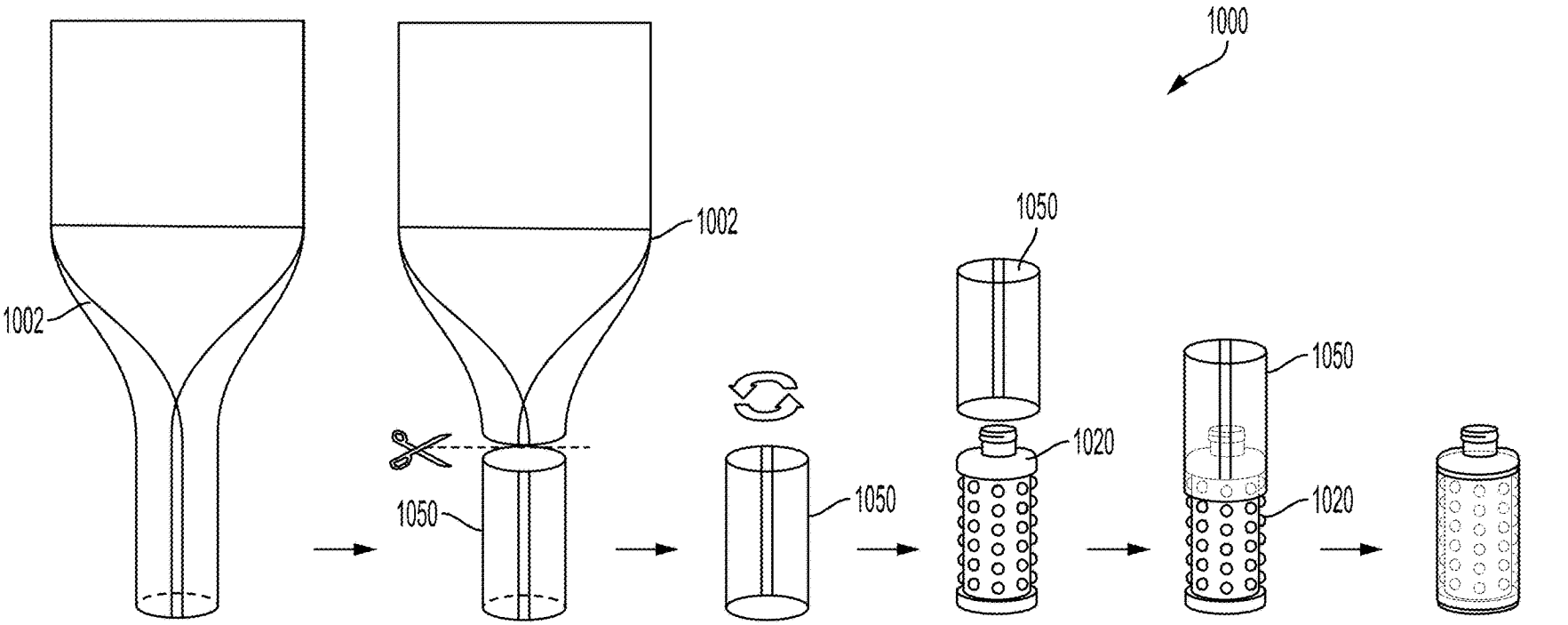
FIGS. 10A-10F show a flow diagram of making a container assembly according to one or more embodiments of the disclosed subject matter.

As shown in FIG. 10A, a flat sheet 1002 of material, such as plastic, can be provided, and curled and opposite ends sealed using an adhesive, such as glue, or heat bonding. End edges of the sheet 1002 may be bonded together in end-to-end fashion or overlapping fashion, such as shown in FIG. 10A. Prior to curling, the sheet 1002 may have provided thereon a label or decoration applied to one or both sides. FIG. 10A, for instance, shows the decoration "ABC."

A size of the curled sheet 1002 may need to be adjusted. For example, as shown in FIG. 10B, one side of the curled sheet 1002 may be cut, leaving a cut sleeve 1050. Of course, it may be necessary to cut both sides of the curled sheet 1002 to produce the sleeve 1050 shown in FIG. 10C, for instance. Alternatively, the sheet 1002 may be sized prior to curling, in one or more embodiments. The resultant sleeve 1050 may be made from a material having a strength sufficient so the sleeve 1050 can stand on its own from either end. Additionally or alternatively, the resultant sleeve 1050 may have a thickness to make the sleeve of sufficient strength to stand on its own from either end.

As shown in FIG. 10D, the sleeve 1050 may be aligned with a container 1020, such as a bottle, so the sleeve 1050 may be fitted over the container 1020. As shown in FIG. 10E, the sleeve 1050 may be slid on the container from a top end of the container 1020. However, additionally or alternatively, the sleeve 1050 may be slid over the container 1020 from the bottom end of the container 1020. In one or more embodiments, the sleeve 1050 may be prevented from sliding over one of the top or the bottom of the container 1020, for instance, due to the configuration of the container 1020. FIG. 10F shows a resultant container 1020 assembly according to one or more embodiments of the disclosed subject matter, where a sleeve 1050 circumscribes a container 1020 to form a resultant container assembly.

FIGS. 11A-11G show a flow diagram of making a sleeve for a container assembly, according to one or more embodiments of the disclosed subject matter.

Figure 11A:
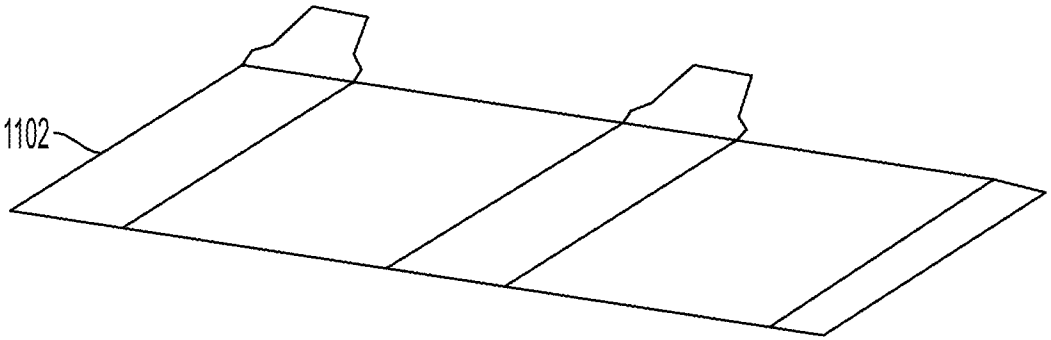
FIGS. 11A-11G show a flow diagram of making a sleeve for a container assembly, according to one or more embodiments of the disclosed subject matter.
Figure 11B:
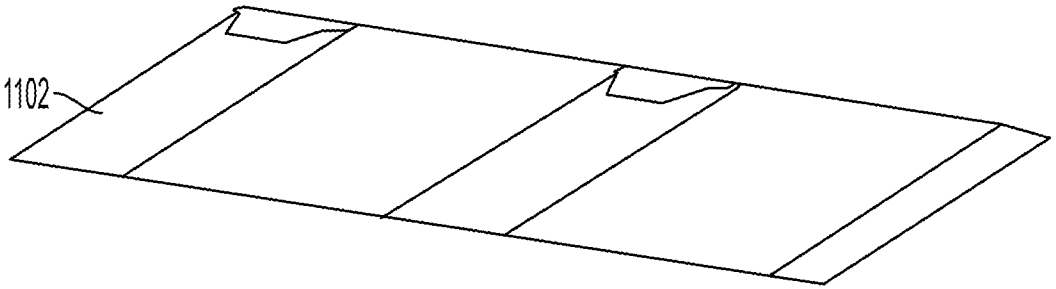
Figure 11C:
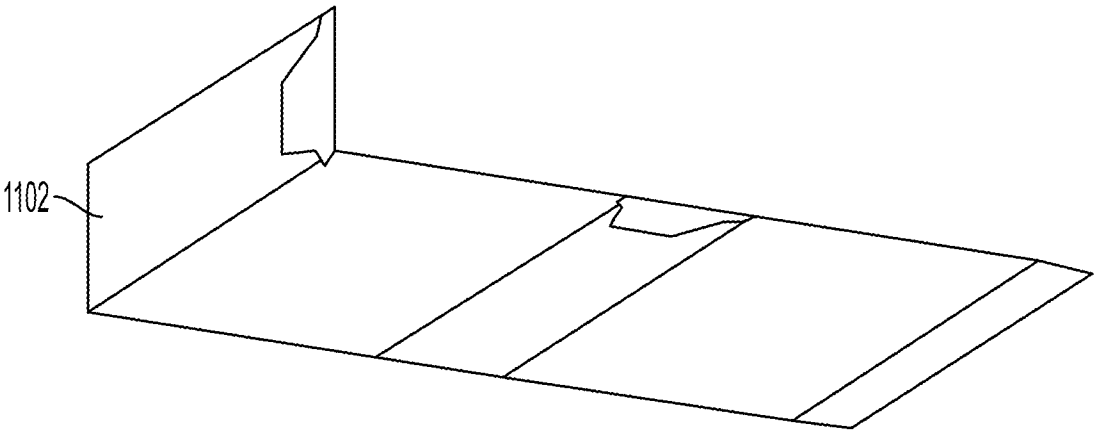
Figure 11D:
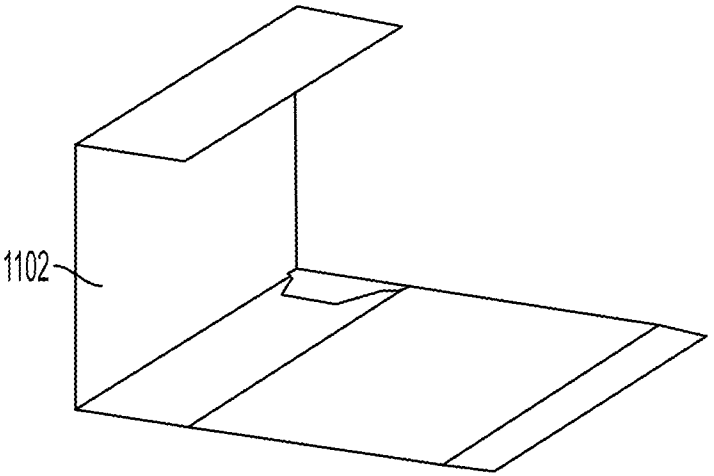
Figure 11E:
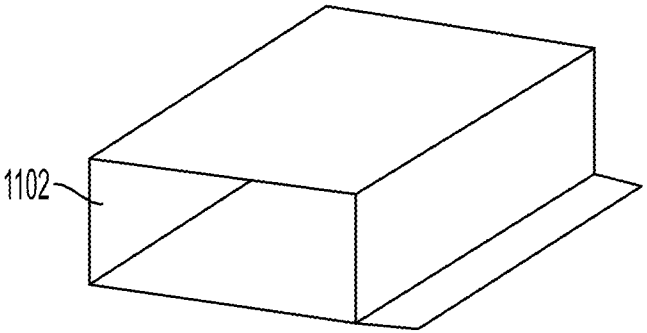
Figure 11F:
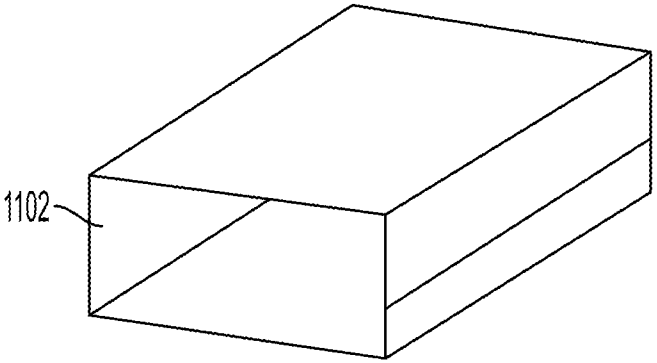
Figure 11G:
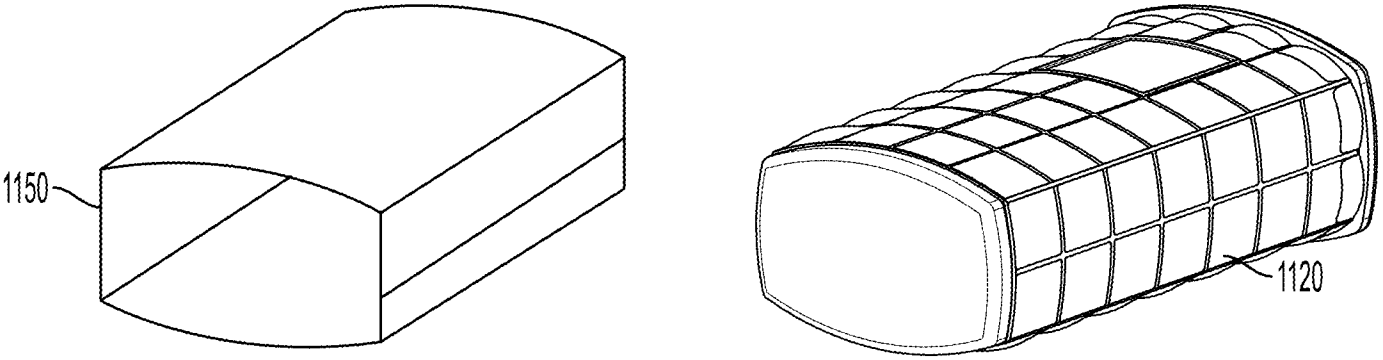

FIG. 11A shows that a sheet 1102, for instance, a plastic sheet, may be provided. The sheet may be uniform or patterned, for instance, with flaps, such as shown in FIG. 11A. Optionally, the sheet 1102 may have predetermined fold indicia. FIG. 11B shows that the flaps may be folded from their position in FIG. 11A, followed by the folding of adjacent portions in FIGS. 11C, 11D, and 11E to create a geometric form with open ends and a remaining adjacent portion. FIG. 11F shows that the remaining adjacent portion may be folded onto the first folded adjacent portion. The remaining adjacent portion may also be fixedly coupled to the first folded adjacent portion using an adhesive or heat bonding, for instance. FIG. 11F shows that the geometric form is rectangular in nature, with open ends. FIG. 11G shows a sleeve 1150 that may be further formed, for instance, front and back sidewalls bowed outward for placement over a container 1120.

Figure 12C:
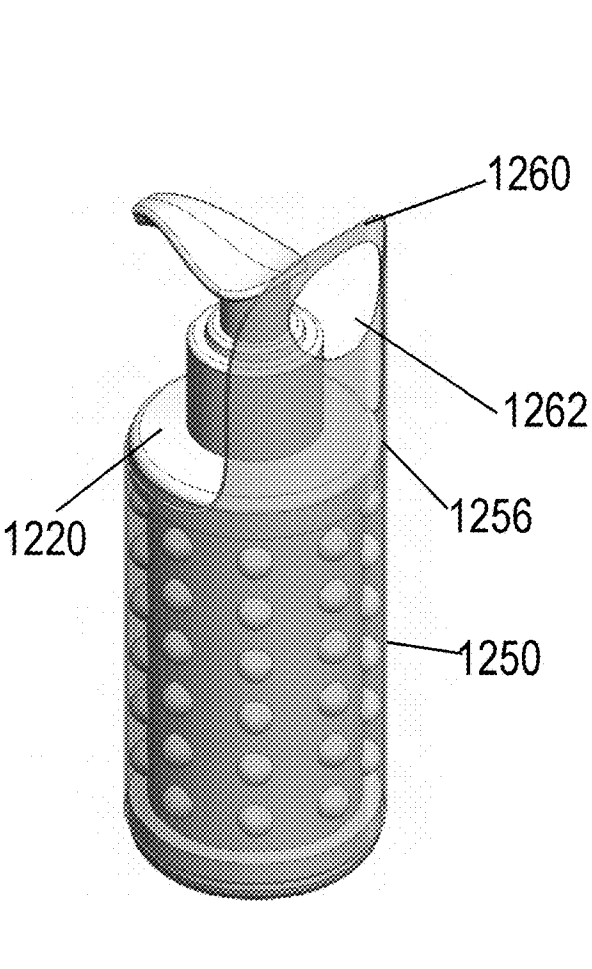
FIGS. 12A-12C show views of a container assembly according to one or more embodiments of the disclosed subject matter.
Figure 12B:
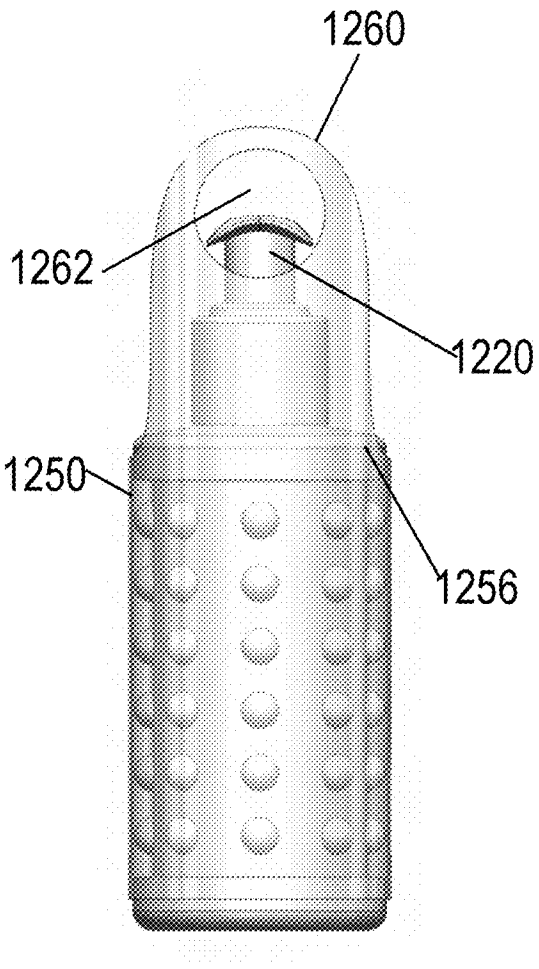
Figure 12A:
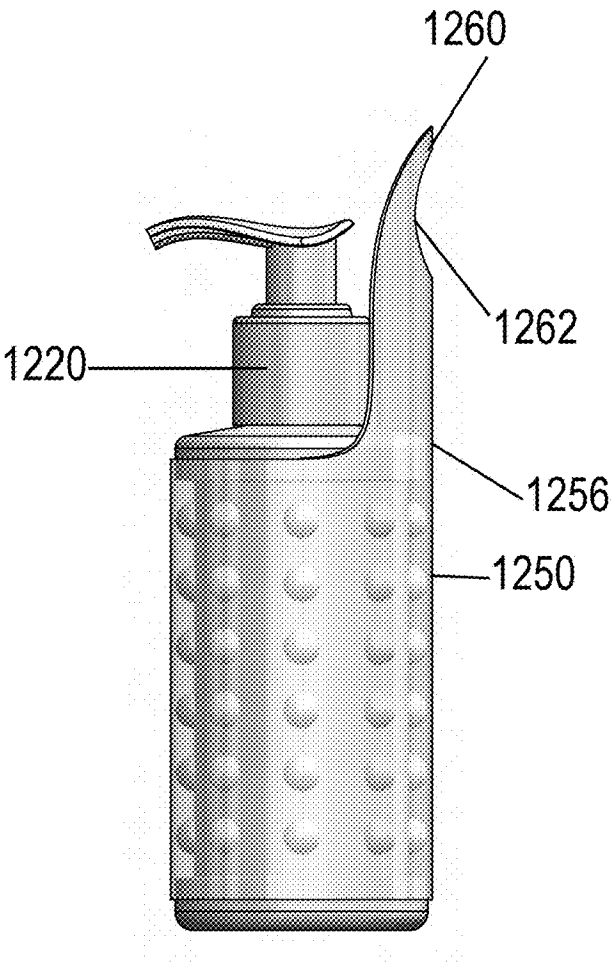

FIGS. 12A-12C show views of a container assembly 1200 according to one or more embodiments of the disclosed subject matter. Notably, a projection 1260 extends from a first end 1256 of sleeve 1250. The projection 1260 may extend from only one side of the first end 1256 of the sleeve 1250, such as shown in FIGS. 12A-12C. Optionally, the projection 1260 may have one or more openings 1262. Opening(s) 1262 may be sized to receive a hook or the like to hang the container assembly 1200. The projection 1260 may extend to a height greater the container 1220, for instance, to a heat greater than a pump head of the container 1220, such as shown in FIGS. 12A-12C. Optionally, the projection 1260 may be curved according to the curvature of the sleeve 1250 and also radially outward, such as shown in FIGS. 12A-12C. The radially outward curvature may facilitate access to the opening(s) 1262 and, hence, hanging, for instance.

Embodiments of the disclosed subject matter may also be as set forth according to the parentheticals in the following paragraphs.

(1) A containment system comprising: a blow molded plastic container configured to directly contain in an inner volume thereof a consumer product, the blow molded plastic container having: a shoulder portion, a base forming a bottom portion of the blow molded plastic container and configured to support the blow molded plastic container in an upright, standing position, on a standing surface, and at least one rigid, vertical sidewall between the shoulder portion and the base, with a surface geometry that precludes receipt of a pre-printed pressure sensitive decoration and direct printing of a decoration, the surface geometry defining a plurality of peaks and a plurality of valleys; and a semi-rigid plastic sleeve having a smooth outer surface, a smooth inner surface, a first open end, and a second open end opposite the first open end, the semi-rigid plastic sleeve surrounding said at least one rigid vertical wall such that the smooth inner surface of the semi-rigid plastic sleeve is fixed to the shoulder portion at the first open end and fixed to the base at the second open end, and in direct contact with the plurality of peaks, wherein the rigid vertical sidewall has a rigidity greater than that of the semi-rigid plastic sleeve, and wherein the semi-rigid plastic sleeve is transparent, semi-transparent, or opaque, except at a decoration area having a decoration thereon.

(2) The containment system according to (1), wherein the sleeve is cylindrical.

(3) The containment system according to (1) or (2), wherein the sleeve has a plurality of sidewalls.

(4) The containment system according to any one of (1) to (3), wherein the rigid vertical sidewall has a thickness greater than that of the semi-rigid plastic sleeve.

(5) The containment system according to any one of (1) to (4), wherein said at least one rigid vertical sidewall includes a plurality of rigid vertical sidewalls.

(6) The containment system according to any one of (1) to (5), wherein the plurality of rigid vertical sidewalls is three or more vertical sidewalls.

(7) The containment system according to any one of (1) to (6), wherein a total number of the sidewall or sidewalls of the sleeve matches a total number of the rigid vertical sidewall or sidewalls of the blow molded plastic container.

(8) The containment system according to any one of (1) to (7), wherein a total number of the sidewall or sidewalls of the sleeve is less than a total number of rigid vertical sidewalls of the blow molded plastic container.

(9) The containment system according to any one of (1) to (8), wherein the second open end of the sleeve is flush with the bottom portion of the base of the blow molded plastic container so as to support the sleeve in the upright standing position on the standing surface.

(10) The containment system according to any one of (1) to (9), wherein the second open end of the sleeve is at a height above the bottom portion of the base of the blow molded plastic container, and configured such that the second open end of the sleeve does not contact the standing surface when the bottom portion of the base of the blow molded plastic container supports the blow molded plastic container in the upright standing position on the standing surface.

(11) The containment system according to any one of (1) to (10), wherein the sleeve is fixed to the shoulder portion at the first open end via one of friction fit, an adhesive, and notch-fit via a notch and notch receptacle configuration.

(12) The containment system according to any one of (1) to (11), wherein the sleeve is fixed to the base at the second open end via one of friction fit, an adhesive, and notch-fit via a notch and notch receptacle configuration.

(13) The containment system according to any one of (1) to (12), wherein the sleeve is formed, from a flat sheet of semi-rigid plastic, such that opposite end portions of the semi-rigid plastic sheet are adjacent to each other.

(14) The containment system according to any one of (1) to (13), wherein the opposite end portions of the semi-rigid plastic sheet are fixedly coupled to each other.

(15) The containment system according to any one of (1) to (14), wherein the opposite end portions of the semi-rigid plastic sheet are fixedly coupled together via one of heat bonding and an adhesive.

(16) A container assembly comprising: a plastic container having: an upper wall portion, a lower wall portion, and a middle wall portion between the upper wall portion and the lower wall portion, the middle well portion having a surface geometry that precludes receipt of a pre-printed pressure sensitive decoration and direct printing of a decoration, the surface geometry defining a plurality of projections; and a plastic sleeve having an outer surface, an inner surface, a first open end, and a second end opposite the first open end, wherein the plastic sleeve surrounds the middle wall portion of the plastic container, wherein the inner surface of the plastic sleeve is adjacent to at least one of the plurality of projections of the surface geometry of the middle wall portion and fixedly coupled to at least one of the upper wall portion at the first open end and the lower wall portion at the second end, and wherein the middle wall portion has a rigidity greater than a rigidity of the plastic sleeve.

(17) The container assembly according to (16), wherein the inner surface of the plastic sleeve contacts at least one of the plurality of projections of the surface geometry of the middle wall portion.

(18) The container assembly according to (16) or (17), wherein the inner surface of the plastic sleeve contacts all of the plurality of projections of the surface geometry of the middle wall portion.

(19) The container assembly according to any one of (16) to (18), wherein the inner surface of the plastic sleeve contacts said at least one of the plurality of projections of the surface geometry of the middle wall portion, but is not fixedly coupled to each said at least one of the plurality of projections.

(20) The container assembly according to any one of (16) to (19), wherein the inner surface of the plastic sleeve does not contact any of the plurality of projections of the surface geometry of the middle wall portion.

(21) The container assembly according to any one of (16) to (20), wherein the rigidity of the plastic sleeve is such that a predetermined amount of inward force applied to the plastic sleeve causes the inner surface of the plastic sleeve to contact at least one of the plurality of projections of the surface geometry of the middle wall portion, and such that the inner surface of the plastic sleeve returns to a pre-inward force position when the predetermined amount of inward force is removed.

(22) The container assembly according to any one of (16) to (21), wherein the inner surface of the plastic sleeve is fixedly coupled to the upper wall portion at the first open end and the lower wall portion at the second end.

(23) The container assembly according to any one of (16) to (22), wherein the inner surface of the plastic sleeve is fixedly coupled to the upper wall portion at the first open end and the lower wall portion at the second end via one of friction fit, an adhesive, and notch-fit via a notch and notch receptacle configuration.

(24) The container assembly according to any one of (16) to (23), wherein the inner surface of the plastic sleeve is fixedly coupled to the upper wall portion at the first open end via one of friction fit, an adhesive, and notch-fit via a notch and notch receptacle configuration, and wherein the inner surface of the plastic sleeve is fixedly coupled to the lower wall portion at the second end via one of friction fit, an adhesive, and notch-fit via a notch and notch receptacle configuration.

(25) The container assembly according to any one of (16) to (24), wherein the inner surface of the plastic sleeve is fixedly coupled to one of the upper wall portion at the first open end and the lower wall portion at the second end, and wherein the inner surface of the plastic sleeve is not fixedly coupled to the other of the upper wall portion at the first open end and the lower wall portion at the second end.

(26) The container assembly according to any one of (16) to (25), wherein the second end of the plastic sleeve is closed.

(27) The container assembly according to any one of (16) to (26), wherein the second end of the plastic sleeve is open.

(28) The container assembly according to any one of (16) to (27), wherein the plastic sleeve is cylindrical.

(29) The container assembly according to any one of (16) to (28), wherein the plastic sleeve has a plurality of sidewalls.

(30) The container assembly according to any one of (16) to (29), wherein the plurality of sidewalls is three or more sidewalls.

(31) The container assembly according to any one of (16) to (31), wherein the middle wall portion is comprised of a plurality of vertical sidewalls.

(32) The container assembly according to any one of (16) to (32), wherein the plurality of vertical sidewalls is three or more vertical sidewalls.

(33) The container assembly according to any one of (16) to (32), wherein a total number of the sidewall or sidewalls of the plastic sleeve matches a total number of sidewall or sidewalls of the middle wall portion of the plastic container.

(34) The container assembly according to any one of (16) to (33), wherein a total number of the sidewall or sidewalls of the sleeve is less than a number of rigid vertical sidewalls of the plastic container.

(35) The container assembly according to any one of (16) to (34), wherein the second end of the plastic sleeve is flush with the lower wall portion of the plastic container such that the second end of the plastic sleeve defines a surface on which to stand the container assembly on a standing surface.

(36) The container assembly according to any one of (16) to (35), wherein the second end of the plastic sleeve defines a surface on which to stand the container assembly on a standing surface.

(37) The container assembly according to any one of (16) to (36), wherein the second end of the plastic sleeve is at a height above a bottom of the lower wall portion of the plastic container, and configured such that the second end of the plastic sleeve does not contact a standing surface when the bottom of the lower wall portion of the plastic container supports the plastic container in an upright standing position on the standing surface.

(38) The container assembly according to any one of (16) to (37), wherein the plastic sleeve is formed, from a flat sheet of semi-rigid plastic, such that opposite end portions of the semi-rigid plastic sheet are adjacent each other.

(39) The container assembly according to any one of (16) to (38), wherein the opposite end portions of the semi-rigid plastic sheet are fixedly coupled to each other.

(40) The containment assembly according to any one of (16) to (39), wherein the opposite end portions of the semi-rigid plastic sheet are fixedly coupled together via one of heat bonding and an adhesive.

(41) The containment assembly according to any one of (16) to (40), wherein the middle wall portion has a maximum thickness greater than that of the plastic sleeve.

(42) A containment system comprising: a container including: an upper wall portion, a lower wall portion, and a middle wall portion between the upper wall portion and the lower wall portion, the middle wall portion having a surface geometry that includes a plurality of projections; and a sleeve including: an outer surface, an inner surface, a first end, and a second end opposite the first end, wherein the inner surface of the sleeve is fixedly coupled to at least one of the upper wall portion, the lower wall portion, and the middle wall portion, and wherein the middle wall portion has a rigidity greater than a rigidity of the sleeve.

(43) The containment system according to (42), wherein the inner surface of the sleeve is fixedly coupled to at least two of the upper wall portion, the lower wall portion, and the middle wall portion.

(44) The containment system according to (42) or (43), wherein the inner surface of the sleeve is fixedly coupled to all of the upper wall portion, the lower wall portion, and the middle wall portion.

(45) The containment system according to any one of (42) to (44), wherein the surface geometry precludes receipt of a pre-printed pressure sensitive decoration and direct printing of a decoration.

(46) The containment system according to any one of (42) to (45), wherein the first end of the sleeve is open and the second end of the sleeve is one of open or closed.

(47) The containment system according to any one of (42) to (46), wherein the sleeve is plastic.

(48) The containment system according to any one of (42) to (47), wherein the container is plastic.

(49) The containment system according to any one of (42) to (48), wherein the inner surface of the sleeve is adjacent to at least one of the plurality of projections of the surface geometry of the middle wall portion.

(50) The containment system according to any one of (42) to (49), wherein the inner surface of the sleeve contacts at least one of the plurality of projections of the surface geometry of the middle wall portion.

(51) The containment system according to any one of (42) to (50), wherein the inner surface of the sleeve contacts all of the plurality of projections of the surface geometry of the middle wall portion.

(52) The containment system according to any one of (42) to (51), wherein the inner surface of the sleeve contacts said at least one of the plurality of projections of the surface geometry of the middle wall portion, but is not fixedly coupled to each said at least one of the plurality of projections.

(53) The containment system according to any one of (42) to (52), wherein the inner surface of the sleeve does not contact any of the plurality of projections of the surface geometry of the middle wall portion.

(54) The containment system according to any one of (42) to (53), wherein the rigidity of the sleeve is such that a predetermined amount of inward force applied to the sleeve causes the inner surface of the sleeve to contact said at least one of the plurality of projections of the surface geometry of the middle wall portion, and such that the inner surface of the sleeve returns to a pre-inward force position when the predetermined amount of inward force is removed.

(55) The containment system according to any one of (42) to (54), wherein the inner surface of the sleeve is fixedly coupled to the upper wall portion at the first end, the lower wall portion at the second end, and/or the middle wall portion via one of friction fit, an adhesive, and notch-fit via a notch and notch receptacle configuration.

(56) The containment system according to any one of (42) to (55), wherein the inner surface of the sleeve is fixedly coupled to the upper wall portion at the first end via one of friction fit, an adhesive, and notch-fit via a notch and notch receptacle configuration, and wherein the inner surface of the sleeve is fixedly coupled to the lower wall portion at the second end via one of friction fit, an adhesive, and notch-fit via a notch and notch receptacle configuration.

(57) The containment system according to any one of (42) to (56), wherein the inner surface of the sleeve is fixedly coupled to the middle wall portion.

(58) The containment system according to any one of (42) to (57), wherein the inner surface of the sleeve is fixedly coupled to one of the upper wall portion at the first end and the lower wall portion at the second end, and wherein the inner surface of the sleeve is not fixedly coupled to the other of the upper wall portion at the first end and the lower wall portion at the second end.

(59) The containment system according to any one of (42) to (58), wherein the sleeve is cylindrical or has a plurality of sidewalls.

(60) The containment system according to any one of (42) to (59), wherein the plurality of sidewalls is three or more sidewalls.

(61) The containment system according to any one of (42) to (60), wherein the middle wall portion is comprised of a plurality of vertical sidewalls.

(62) The containment system according to any one of (42) to (61), wherein the plurality of vertical sidewalls is three or more vertical sidewalls.

(63) The containment system according to any one of (42) to (62), wherein a total number of the sidewall or sidewalls of the sleeve matches a total number of sidewall or sidewalls of the middle wall portion of the container.

(64) The containment system according to any one of (42) to (63), wherein a total number of the sidewall or sidewalls of the sleeve is less than a number of rigid vertical sidewalls of the container.

(65) The containment system according to any one of (42) to (64), wherein the second end of the sleeve is flush with the lower wall portion of the container such that the second end of the sleeve defines a surface on which to stand on a standing surface.

(66) The containment system according to any one of (42) to (65), wherein the second end of the sleeve defines a surface on which to stand on a standing surface.

(67) The containment system according to any one of (42) to (66), wherein the second end of the sleeve is at a height above a bottom of the lower wall portion of the container, and configured such that the second end of the sleeve does not contact a standing surface when the bottom of the lower wall portion of the container supports the container in an upright standing position on the standing surface.

(68) The containment system according to any one of (42) to (67), wherein the sleeve is formed, from a flat sheet of semi-rigid plastic, such that opposite end portions of the semi-rigid plastic sheet are adjacent each other.

(69) The containment system according to any one of (42) to (68), wherein the opposite end portions of the semi-rigid plastic sheet are fixedly coupled to each other.

(70) The containment system according to any one of (42) to (69), wherein the opposite end portions of the semi-rigid plastic sheet are fixedly coupled together via one of heat bonding and an adhesive.

(71) The containment system according to any one of (42) to (70), wherein the sleeve is one of clear, semi-transparent, or opaque.

(72) A method comprising: providing a container having: an upper wall portion, a lower wall portion, and a middle wall portion between the upper wall portion and the lower wall portion, the middle wall portion having a surface geometry that includes a plurality of projections; providing a sleeve having: an outer surface, an inner surface, a first end, and a second end opposite the first end, wherein the inner surface of the sleeve is fixedly coupled to at least one of the upper wall portion, the lower wall portion, and the middle wall portion, and wherein the middle wall portion has a rigidity greater than a rigidity of the sleeve.

(73) The method according to (72), further comprising: forming the sleeve, said forming including, from a flat sheet of semi-rigid plastic, forming the flat sheet such that opposite end portions of the semi-rigid plastic sheet are adjacent each other.

(74) The method according to (72) or (73), wherein said forming the sleeve includes fixedly coupling open end portions of the semi-rigid plastic sheet to each other.

(75) The method according to any one of (72) to (74), wherein the opposite end portions of the semi-rigid plastic sheet are fixedly coupled together via one of heat bonding and an adhesive.

(76) The method according to any one of (72) to (75), wherein the inner surface of the sleeve is fixedly coupled to at least two of the upper wall portion, the lower wall portion, and the middle wall portion.

(77) The method according to any one of (72) to (76), wherein the inner surface of the sleeve is fixedly coupled to all of the upper wall portion, the lower wall portion, and the middle wall portion.

(78) The method according to any one of (72) to (77), wherein the surface geometry precludes receipt of a pre-printed pressure sensitive decoration and direct printing of a decoration.

(79) The method according to any one of (72) to (78), wherein the first end of the sleeve is open and the second end of the sleeve is one of open or closed.

(80) The method according to any one of (72) to (79), wherein the sleeve is plastic.

(81) The method according to any one of (72) to (80), wherein the container is plastic.

(82) The method according to any one of (72) to (81), wherein the inner surface of the sleeve is adjacent to at least one of the plurality of projections of the surface geometry of the middle wall portion.

(83) The method according to any one of (72) to (82), wherein the inner surface of the sleeve contacts at least one of the plurality of projections of the surface geometry of the middle wall portion.

(84) The method according to any one of (72) to (83), wherein the inner surface of the sleeve contacts all of the plurality of projections of the surface geometry of the middle wall portion.

(85) The method according to any one of (72) to (84), wherein the inner surface of the sleeve contacts said at least one of the plurality of projections of the surface geometry of the middle wall portion, but is not fixedly coupled to each said at least one of the plurality of projections.

(86) The method according to any one of (72) to (85), wherein the inner surface of the sleeve does not contact any of the plurality of projections of the surface geometry of the middle wall portion in an initial state of the sleeve.

(87) The method according to any one of (72) to (86), wherein the rigidity of the sleeve is such that a predetermined amount of inward force applied to the sleeve when the sleeve is in the initial state causes the inner surface of the sleeve to contact said at least one of the plurality of projections of the surface geometry of the middle wall portion, and such that the inner surface of the sleeve returns to a pre-inward force position when the predetermined amount of inward force is removed.

(88) The method according to any one of (72) to (87), wherein the inner surface of the sleeve is fixedly coupled to the upper wall portion at the first end, the lower wall portion at the second end, and/or the middle wall portion via one of friction fit, an adhesive, and notch-fit via a notch and notch receptacle configuration.

(89) The method according to any one of (72) to (88), wherein the inner surface of the sleeve is fixedly coupled to the upper wall portion at the first end via one of friction fit, an adhesive, and notch-fit via a notch and notch receptacle configuration, and wherein the inner surface of the sleeve is fixedly coupled to the lower wall portion at the second end via one of friction fit, an adhesive, and notch-fit via a notch and notch receptacle configuration.

(90) The method according to any one of (72) to (89), wherein the inner surface of the sleeve is fixedly coupled to one of the upper wall portion at the first end and the lower wall portion at the second end, and wherein the inner surface of the sleeve is not fixedly coupled to the other of the upper wall portion at the first end and the lower wall portion at the second end.

(91) The method according to any one of (72) to (90), wherein the sleeve is cylindrical.

(92) The method according to any one of (72) to (91), wherein the sleeve has a plurality of sidewalls.

(93) The method according to any one of (72) to (92), wherein the plurality of sidewalls is three or more sidewalls.

(94) The method according to any one of (72) to (93), wherein the middle wall portion is comprised of a plurality of vertical sidewalls.

(95) The method according to any one of (72) to (94), wherein the plurality of vertical sidewalls is three or more vertical sidewalls.

(96) The method according to any one of (72) to (95), wherein a total number of the sidewall or sidewalls of the sleeve matches a total number of sidewall or sidewalls of the middle wall portion of the container.

(97) The method according to any one of (72) to (96), wherein a total number of the sidewall or sidewalls of the sleeve is less than a number of rigid vertical sidewalls of the container.

(98) The method according to any one of (72) to (97), wherein the second end of the sleeve is flush with the lower wall portion of the container such that the second end of the sleeve defines a surface on which to stand on a standing surface.

(99) The method according to any one of (72) to (98), wherein the second end of the sleeve defines a surface on which to stand on a standing surface.

(100) The method according to any one of (72) to (99), wherein the second end of the sleeve is at a height above a bottom of the lower wall portion of the container, and configured such that the second end of the sleeve does not contact a standing surface when the bottom of the lower wall portion of the container supports the container in an upright standing position on the standing surface.

(101) The method according to any one of (72) to (100), wherein the sleeve is one of clear, semi-transparent, or opaque.

(102) The method according to any one of (72) to (101), wherein a maximum thickness of the sleeve is less than a maximum thickness of the middle wall portion, the upper wall portion, and/or the lower wall portion.

Having now described embodiments of the disclosed subject matter, it should be apparent to those skilled in the art that the foregoing is merely illustrative and not limiting, having been presented by way of example only. Thus, although particular configurations have been discussed and illustrated herein, other configurations can be and are also employed. Further, numerous modifications and other embodiments (e.g., combinations, rearrangements, etc.) are enabled by the present disclosure and are contemplated as falling within the scope of the disclosed subject matter and any equivalents thereto. Features of the disclosed embodiments can be combined, rearranged, omitted, etc., within the scope of described subject matter to produce additional embodiments. Furthermore, certain features may sometimes be used to advantage without a corresponding use of other features. Accordingly, Applicant intends to embrace all such alternatives, modifications, equivalents, and variations that are within the spirit and scope of the present disclosure. Further, it is therefore to be understood that within the scope of the appended claims, the disclosure may be practiced otherwise than as specifically described herein.

LISTING OF ELEMENTS

100 container assembly
120 container
121 inner volume
122 upper wall portion
123 shoulder
124 neck
125 lower wall portion
126 base
130 middle wall portion
132 projections/raised portions
134 non-raised portions
150 sleeve
152 outer surface
154 inner surface
156 first end of sleeve
158 second end of sleeve
160 first coupling area
162 second coupling area
165 contact area
200 containment system
210 dispensing assembly
220 container
225 lower wall portion
230 middle wall portion
232 projections/raised portions
234 non-raised portions
250 sleeve
256 first end of sleeve
260 snap fit
300 containment system
310 dispensing assembly
312 cap
320 container
322 upper wall portion
330 middle wall portion
332 projections/raised portions
334 non-raised portions
350 sleeve
356 first end of sleeve
358 second end of sleeve
400 containment system
420 container
430 middle wall portion
432 projections or raised portions
434 non-raised portions
450 sleeve
451 label or decoration area
500 containment system
510 dispensing assembly
520 container
522 upper wall portion
525 lower wall portion
530 middle wall portion
532 projections/raised portions
534 non-raised portions
550 sleeve
551 label/decoration area
556 first end of sleeve
558 second end of sleeve
560 locking tabs
620 container
720 container
722 upper wall portion
725 lower wall portion
730 middle portion
732 projections/raised portions
734 non-raised portions
770 tab
820 container
900 method
902 block
904 block

1000 method
1002 sheet
1020 container
1050 sleeve
1102 sheet
1120 container
1150 sleeve
1220 container
1250 sleeve
1256 first end of sleeve
1260 projection
1262 opening

What is claimed is:

1. A containment system comprising:

a blow molded plastic container configured to directly contain in an inner volume thereof a consumer product, the blow molded plastic container having:

a shoulder portion, a base forming a bottom portion of the blow molded plastic container and configured to support the blow molded plastic container in an upright, standing position, on a standing surface, and at least one rigid vertical sidewall between the shoulder portion and the base, with a surface geometry that precludes receipt of a pre-printed pressure sensitive decoration and direct printing of a decoration, the surface geometry defining a plurality of peaks and a plurality of valleys; and a semi-rigid plastic sleeve having a smooth outer surface, a smooth inner surface, a first open end, and a second open end opposite the first open end, the semi-rigid plastic sleeve surrounding said at least one rigid vertical sidewall such that the smooth inner surface of the semi-rigid plastic sleeve is fixed to the shoulder portion at the first open end and fixed to the base at the second open end, and in direct contact with the plurality of peaks, wherein the rigid vertical sidewall has a rigidity greater than a rigidity of the semi-rigid plastic sleeve, wherein the semi-rigid plastic sleeve is transparent, semi-transparent, or opaque, except at a decoration area having a decoration thereon, wherein the second open end of the semi-rigid plastic sleeve is flush with the base so as to support the blow molded plastic container, and wherein the rigidity of the semi-rigid plastic sleeve allows the semi-rigid plastic sleeve to have an original form such that the semi-rigid plastic sleeve is allowed to deform inward under a squeezing force and allowed to return to the original form when the squeezing force is removed.

2. The containment system according to claim 1, wherein the rigid vertical sidewall has a thickness greater than that of the semi-rigid plastic sleeve.

3. The containment system according to claim 1, wherein the semi-rigid plastic sleeve is fixed to the shoulder portion at the first open end via one of friction fit, an adhesive, and notch-fit via a notch and notch receptacle configuration.

4. The containment system according to claim 1, wherein the semi-rigid plastic sleeve is formed, from a flat sheet of semi-rigid plastic, such that opposite end portions of the semi-rigid plastic sheet are adjacent to each other.

5. The containment system according to claim 1, wherein the rigidity of the semi-rigid plastic sleeve allows the semi-rigid plastic sleeve to have the original form such that the semi-rigid plastic sleeve is allowed to deform inward, under the squeezing force, to contact at least one of the plurality of valleys of the surface geometry, and allowed to return to the original form when the squeezing force is removed.

6. A container assembly comprising:

a plastic container having:

an upper wall portion, a lower wall portion, and a middle wall portion between the upper wall portion and the lower wall portion, the middle wall portion having a surface geometry that precludes receipt of a pre-printed pressure sensitive decoration and direct printing of a decoration, the surface geometry defining a plurality of projections; and a plastic sleeve having an outer surface, an inner surface, a first open end, and a second end opposite the first open end, wherein the plastic sleeve surrounds the middle wall portion of the plastic container, wherein the inner surface of the plastic sleeve is adjacent to at least one of the plurality of projections of the surface geometry of the middle wall portion and fixedly coupled to at least one of the upper wall portion at the first open end and the lower wall portion at the second end, wherein the middle wall portion has a rigidity greater than a rigidity of the plastic sleeve, wherein the second end of the plastic sleeve supports the plastic container, and wherein the rigidity of the plastic sleeve allows the plastic sleeve to have an original form such that the plastic sleeve is allowed to deform inward under a predetermined amount of inward force and allowed to return to the original form when the predetermined amount of inward force is removed.

7. The container assembly according to claim 6, wherein the inner surface of the plastic sleeve contacts all of the plurality of projections of the surface geometry of the middle wall portion when the plastic sleeve is in the original form.

8. The container assembly according to claim 6, wherein the inner surface of the plastic sleeve does not contact any of the plurality of projections of the surface geometry of the middle wall portion when the plastic sleeve is in the original form.

9. The container assembly according to claim 8, wherein the inner surface of the plastic sleeve is fixedly coupled to the upper wall portion at the first open end and the lower wall portion at the second end via one of friction fit, an adhesive, and notch-fit via a notch and notch receptacle configuration.

10. The container assembly according to claim 6, wherein the rigidity of the plastic sleeve is such that the predetermined amount of inward force applied to the plastic sleeve causes the plastic sleeve to contact the at least one of the plurality of projections of the surface geometry of the middle wall portion, and such that the plastic sleeve returns to the original form when the predetermined amount of inward force is removed.

11. The container assembly according to claim 6, wherein the second end of the plastic sleeve is open.

12. The container assembly according to claim 6, wherein the second end of the plastic sleeve defines a surface on which to stand the container assembly on a standing surface.

13. The container assembly according to claim 6, wherein the middle wall portion has a maximum thickness greater than that of the plastic sleeve.

14. The container assembly according to claim 6, wherein the plastic container has a base forming a bottom portion of the plastic container, for supporting the plastic container in an upright, standing position, on a standing surface, and the second end of the plastic sleeve is flush with the base so as to support the plastic container.

15. A method comprising:

providing a container having:

an upper wall portion, a lower wall portion, and a middle wall portion between the upper wall portion and the lower wall portion, the middle wall portion having a surface geometry that includes a plurality of projections; and providing a sleeve having:

an outer surface, an inner surface, a first end, and a second end opposite the first end, wherein the inner surface of the sleeve is fixedly coupled to at least one of the upper wall portion, the lower wall portion, and the middle wall portion, wherein the middle wall portion has a rigidity greater than a rigidity of the sleeve, wherein the second end of the sleeve supports the container, and wherein the rigidity of the sleeve allows the sleeve to have an original form such that the sleeve is allowed to deform inward under a squeezing force and allowed to return to the original form when the squeezing force is removed.

16. The method according to claim 15, further comprising:

forming the sleeve, said forming including, from a flat sheet of semi-rigid plastic, forming the flat sheet such that opposite end portions of the semi-rigid plastic sheet are adjacent each other.

17. The method according to claim 16, wherein said forming the sleeve includes fixedly coupling open end portions of the semi-rigid plastic sheet to each other.

18. The method according to claim 15, wherein the inner surface of the sleeve is fixedly coupled to at least two of the upper wall portion, the lower wall portion, and the middle wall portion.

19. The method according to claim 15, wherein the surface geometry precludes receipt of a pre-printed pressure sensitive decoration and direct printing of a decoration.

20. The method according to claim 15, wherein the first end of the sleeve is open and the second end of the sleeve is one of open or closed.

21. The method according to claim 15, wherein the second end of the sleeve defines a surface on which to stand on a standing surface.

22. The method according to claim 15, wherein the container has a base forming a bottom portion of the container, for supporting the container in an upright, standing position, on a standing surface, and the second end of the sleeve is flush with the base so as to support the container.

23. The method according to claim 15, wherein the rigidity of the sleeve allows the sleeve to have the original form such that the sleeve is allowed to deform inward, under the squeezing force, to contact at least one of the plurality of projections of the surface geometry of the middle wall portion, and allowed to return to the original form when the squeezing force is removed.

* * * * *